US009316175B2

(12) United States Patent
Raasch

(10) Patent No.: US 9,316,175 B2
(45) Date of Patent: Apr. 19, 2016

(54) VARIABLE VENTURI AND ZERO DROOP VACUUM ASSIST

(71) Applicant: Briggs & Stratton Corporation, Wauwatosa, WI (US)

(72) Inventor: Jason J. Raasch, Cedarburg, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 234 days.

(21) Appl. No.: 13/922,713

(22) Filed: Jun. 20, 2013

(65) Prior Publication Data

US 2013/0276751 A1 Oct. 24, 2013

Related U.S. Application Data

(63) Continuation-in-part of application No. 13/092,027, filed on Apr. 21, 2011, now Pat. No. 8,910,616, and a continuation-in-part of application No. 13/492,680, filed on Jun. 8, 2012, now Pat. No. 8,915,231, which is a continuation-in-part of application No. 12/725,311, filed on Mar. 16, 2010, now Pat. No. 8,726,882.

(51) Int. Cl.
*F02M 1/02* (2006.01)
*F02D 35/00* (2006.01)
(Continued)

(52) U.S. Cl.
CPC ..... *F02M 1/02* (2013.01); *F02D 35/0076* (2013.01); *F02M 7/17* (2013.01); *F02M 17/48* (2013.01); *F02M 19/12* (2013.01); *F02D 9/103* (2013.01); *F02D 9/14* (2013.01)

(58) Field of Classification Search
CPC ..... F02D 35/0076; F02D 9/14; F02D 9/103
USPC ..... 123/439, 437, 442, 704, 441, 376; 261/44.9, 42, DIG. 54
See application file for complete search history.

(56) References Cited

U.S. PATENT DOCUMENTS 1,128,782 A 2/1915 Hartford
1,265,883 A 5/1918 Church
(Continued)

FOREIGN PATENT DOCUMENTS

GB 14914 10/1915
JP 55-001420 A 1/1980
(Continued)

OTHER PUBLICATIONS

Honda Power Equipment; printed from website http://www.hondapowerequipment.com/products/generators/content.aspx on Mar. 15, 2010, 5 pages.
Honda; V-Twin Engines, © 2002, American Honda Motor Co., Inc., 10 pages.
(Continued)

*Primary Examiner* — Mahmoud Gimie
(74) *Attorney, Agent, or Firm* — Foley & Lardner LLP

(57) ABSTRACT

An engine includes a carburetor including a variable venturi having a fixed surface and an adjustable surface that form a constricted section, a throttle valve downstream of the variable venturi, a governor assembly including a governor configured to detect an engine speed of the engine, a governor arm coupled to the governor, the venturi, and the throttle valve, and a governor spring coupled to the governor arm to bias the throttle valve towards the fully open position, and a vacuum actuator including an actuator linkage coupled to the governor spring and also coupled to a pressure-sensitive member for movement with the pressure-sensitive member in response to an engine vacuum, and an actuator spring biasing the actuator linkage to increase the tension on the governor spring.

18 Claims, 31 Drawing Sheets

(51) Int. Cl.

| | |
|---|---|
| ***F02M 7/17*** | (2006.01) |
| ***F02M 17/48*** | (2006.01) |
| ***F02M 19/12*** | (2006.01) |
| *F02D 9/10* | (2006.01) |
| *F02D 9/14* | (2006.01) |

(56) References Cited

U.S. PATENT DOCUMENTS

| | | | | | |
|---|---|---|---|---|---|
| 1,459,961 | A | * | 6/1923 | Wheeler | 417/159 |
| 1,745,492 | A | | 2/1930 | Kelch et al. | |
| 1,982,945 | A | | 12/1934 | Armstrong | |
| 2,009,659 | A | | 7/1935 | Hill et al. | |
| 2,022,094 | A | | 11/1935 | Shoemaker et al. | |
| 2,134,889 | A | | 1/1938 | Phillips | |
| 2,138,100 | A | | 11/1938 | Howard | |
| 2,221,201 | A | | 11/1940 | Pope, Jr. et al. | |
| 2,241,096 | A | | 5/1941 | McCullough | |
| 2,338,912 | A | | 1/1944 | Ericson | |
| 2,367,606 | A | | 1/1945 | Olson | |
| 2,382,952 | A | | 8/1945 | Armstrong | |
| 2,393,556 | A | * | 1/1946 | Olson et al. | 123/376 |
| 2,397,208 | A | | 3/1946 | Saco, Jr. et al. | |
| 2,450,037 | A | * | 9/1948 | Dulong | 137/483 |
| 2,499,263 | A | | 2/1950 | Troy | |
| 2,529,437 | A | | 11/1950 | Weinberger | |
| 2,533,180 | A | | 12/1950 | Rhodes | |
| 2,544,607 | A | | 3/1951 | Mallory | |
| 2,585,814 | A | | 2/1952 | McDonald | |
| 2,613,657 | A | | 10/1952 | Sloane et al. | |
| 2,635,596 | A | | 4/1953 | Adler | |
| 2,716,397 | A | | 8/1955 | Heinish | |
| 2,781,751 | A | | 2/1957 | Benjamin | |
| 2,804,552 | A | | 8/1957 | McFarland | |
| 2,837,070 | A | | 6/1958 | Agar | |
| 2,867,196 | A | | 1/1959 | Francis | |
| 2,947,600 | A | | 8/1960 | Clayton | |
| 3,133,531 | A | * | 5/1964 | Cramer | 123/389 |
| 3,139,079 | A | | 6/1964 | Bettoni | |
| 3,209,532 | A | | 10/1965 | Morris et al. | |
| 3,217,652 | A | | 11/1965 | Olson | |
| 3,242,741 | A | | 3/1966 | Catterson | |
| 3,276,439 | A | | 10/1966 | Reichenbach | |
| 3,280,903 | A | | 10/1966 | Stoddard, Jr. | |
| 3,306,035 | A | | 2/1967 | Morrell | |
| 3,354,873 | A | | 11/1967 | Burnell | |
| 3,476,094 | A | | 11/1969 | Guernsey et al. | |
| 3,659,499 | A | | 5/1972 | Woodward | |
| 3,666,057 | A | | 5/1972 | Leifer et al. | |
| 3,760,785 | A | | 9/1973 | Harrison et al. | |
| 3,786,869 | A | | 1/1974 | McLoughlin | |
| 3,847,131 | A | | 11/1974 | Hisatomi | |
| 3,881,685 | A | | 5/1975 | Hase et al. | |
| 3,911,063 | A | * | 10/1975 | Barnes, Jr. | 261/50.1 |
| 3,937,302 | A | | 2/1976 | Palmcrantz | |
| 3,971,356 | A | | 7/1976 | Schlage | |
| 3,982,397 | A | | 9/1976 | Laurent | |
| 3,983,697 | A | | 10/1976 | Goto et al. | |
| 3,997,019 | A | | 12/1976 | Inoue | |
| 4,022,179 | A | | 5/1977 | Kalert et al. | |
| 4,083,338 | A | | 4/1978 | Bertling et al. | |
| 4,084,373 | A | | 4/1978 | Hashimoto et al. | |
| 4,094,284 | A | | 6/1978 | Gesell | |
| 4,103,652 | A | | 8/1978 | Garside et al. | |
| 4,117,640 | A | | 10/1978 | Vanderstar | |
| 4,139,332 | A | | 2/1979 | Cantrell et al. | |
| 4,154,058 | A | | 5/1979 | Mase et al. | |
| 4,165,611 | A | | 8/1979 | Ishikawa | |
| 4,176,642 | A | | 12/1979 | Shipinski | |
| 4,290,399 | A | | 9/1981 | Takada et al. | |
| 4,304,202 | A | | 12/1981 | Schofield | |
| 4,342,299 | A | | 8/1982 | Haka | |
| 4,355,611 | A | | 10/1982 | Hasegawa | |
| 4,368,704 | A | | 1/1983 | Masaki | |
| 4,370,960 | A | | 2/1983 | Otsuka | |
| 4,383,510 | A | | 5/1983 | Nakamura et al. | |
| 4,387,565 | A | | 6/1983 | Otani et al. | |
| 4,391,246 | A | | 7/1983 | Kawabata et al. | |
| 4,395,876 | A | | 8/1983 | Marsee et al. | |
| 4,425,888 | A | | 1/1984 | Engel et al. | |
| 4,437,306 | A | | 3/1984 | Ikenoya et al. | |
| 4,450,932 | A | | 5/1984 | Khosropour et al. | |
| 4,502,436 | A | | 3/1985 | Bonfiglioli et al. | |
| 4,510,903 | A | | 4/1985 | Sakakiyama | |
| 4,526,060 | A | | 7/1985 | Watanabe | |
| 4,530,334 | A | | 7/1985 | Pagdin | |
| 4,530,805 | A | * | 7/1985 | Abbey | 261/53 |
| 4,546,744 | A | | 10/1985 | Bonfiglioli | |
| 4,549,400 | A | | 10/1985 | King | |
| 4,559,185 | A | | 12/1985 | Seto et al. | |
| 4,567,870 | A | | 2/1986 | Tumber | |
| 4,640,245 | A | | 2/1987 | Matsuda et al. | |
| 4,660,518 | A | | 4/1987 | Tamaki | |
| 4,709,675 | A | | 12/1987 | Fujita | |
| 4,773,369 | A | | 9/1988 | Kobayashi et al. | |
| 4,783,286 | A | * | 11/1988 | Lee | 261/23.2 |
| 4,793,309 | A | | 12/1988 | Huffman et al. | |
| 4,836,164 | A | | 6/1989 | Morozumi et al. | |
| 4,836,167 | A | | 6/1989 | Huffman et al. | |
| 4,884,541 | A | | 12/1989 | Marriott | |
| 4,941,443 | A | | 7/1990 | Yamaguchi et al. | |
| 4,944,267 | A | | 7/1990 | Mann | |
| 4,969,435 | A | | 11/1990 | Morikawa et al. | |
| 4,977,879 | A | | 12/1990 | Schmidt et al. | |
| 5,003,949 | A | | 4/1991 | Fanner et al. | |
| 5,035,580 | A | | 7/1991 | Simonette | |
| 5,060,744 | A | | 10/1991 | Katoh et al. | |
| 5,069,180 | A | | 12/1991 | Schmidt et al. | |
| 5,146,889 | A | | 9/1992 | Swanson et al. | |
| 5,186,142 | A | | 2/1993 | Brunelli et al. | |
| 5,203,302 | A | * | 4/1993 | Parnitzke | 123/376 |
| 5,208,519 | A | | 5/1993 | Dykstra et al. | |
| 5,235,804 | A | | 8/1993 | Colket et al. | |
| 5,235,943 | A | | 8/1993 | Fiorenza, II | |
| 5,293,854 | A | | 3/1994 | Tracy et al. | |
| 5,345,763 | A | | 9/1994 | Sato | |
| 5,351,529 | A | | 10/1994 | Locke, Sr. | |
| 5,431,013 | A | | 7/1995 | Yamaki et al. | |
| 5,459,664 | A | | 10/1995 | Buckalew | |
| 5,459,998 | A | | 10/1995 | Hosoya et al. | |
| 5,479,908 | A | | 1/1996 | Grinberg et al. | |
| 5,503,125 | A | | 4/1996 | Gund | |
| 5,526,786 | A | | 6/1996 | Beck et al. | |
| 5,595,531 | A | | 1/1997 | Niemela et al. | |
| 5,642,711 | A | | 7/1997 | Boner et al. | |
| D382,853 | S | | 8/1997 | Crawford | |
| 5,666,804 | A | | 9/1997 | Sekiya et al. | |
| 5,680,024 | A | | 10/1997 | Ehle et al. | |
| 5,720,906 | A | | 2/1998 | Yamanaka et al. | |
| 5,726,503 | A | | 3/1998 | Domanski et al. | |
| 5,810,560 | A | | 9/1998 | Tanaka | |
| 5,902,971 | A | | 5/1999 | Sato et al. | |
| 6,021,370 | A | | 2/2000 | Bellinger et al. | |
| 6,092,793 | A | | 7/2000 | Yanagii | |
| 6,113,193 | A | | 9/2000 | Kunzeman | |
| 6,216,453 | B1 | | 4/2001 | Maurer | |
| 6,276,449 | B1 | | 8/2001 | Newman | |
| 6,365,982 | B1 | | 4/2002 | Iles et al. | |
| 6,435,482 | B1 | | 8/2002 | Omi et al. | |
| 6,971,369 | B1 | | 12/2005 | Mitchell et al. | |
| 6,983,736 | B2 | | 1/2006 | Mitchell et al. | |
| 7,353,802 | B1 | | 4/2008 | Iwata et al. | |
| 7,373,921 | B2 | | 5/2008 | Geyer et al. | |
| 7,950,366 | B2 | | 5/2011 | Arai et al. | |
| 8,567,371 | B2 | | 10/2013 | Vaughn et al. | |
| 2002/0053339 | A1 | | 5/2002 | Bootle et al. | |
| 2003/0037749 | A1 | | 2/2003 | Imafuku et al. | |
| 2004/0112333 | A1 | | 6/2004 | Mitchell et al. | |
| 2006/0054381 | A1 | | 3/2006 | Takemoto et al. | |
| 2006/0151891 | A1 | | 7/2006 | Meyer | |
| 2007/0068496 | A1 | | 3/2007 | Wright | |
| 2007/0079604 | A1 | | 4/2007 | Macaluso | |
| 2007/0240404 | A1 | | 10/2007 | Pekrul et al. | |

(56) References Cited

U.S. PATENT DOCUMENTS

| | | | | |
|---|---|---|---|---|
| 2008/0014096 | A1 | 1/2008 | Gilpatrick | |
| 2008/0245899 | A1* | 10/2008 | Parris et al. | 239/526 |
| 2011/0005024 | A1 | 1/2011 | Spitler et al. | |
| 2011/0214641 | A1 | 9/2011 | Vaughn et al. | |
| 2011/0226217 | A1 | 9/2011 | Raasch | |

FOREIGN PATENT DOCUMENTS

| | | |
|---|---|---|
| JP | 61-207836 | 9/1986 |
| JP | 11-093750 | 4/1999 |
| SU | 853138 | 8/1981 |
| SU | 1740741 (A1) | 6/1992 |

OTHER PUBLICATIONS

Honda; V-Twin Series Engines, © 2009, American Honda Motor Co., Inc., 11 pages.

International Search Report and Written Opinion for International Application No. PCT/US2012/33891, mail date Aug. 9, 2012, 6 pages.

International Search Report and Written Opinion for International Application No. PCT/US2013/043758, dated Sep. 24, 2013, 16 pages.

Partial International Search Report regarding International Application No. PCT/US2013/043758, dated Aug. 2, 2013, 2 pages.

Office Action for U.S. Appl. No. 12/725,311, mail date Sep. 24, 2013, 5 pages.

* cited by examiner

VARIABLE VENTURI AND ZERO DROOP VACUUM ASSIST

CROSS-REFERENCE TO RELATED PATENT APPLICATIONS

This application is a continuation-in-part of U.S. patent application Ser. No. 13/492,680, filed Jun. 8, 2012, which is a continuation-in-part of U.S. patent application Ser. No. 12/725,311, filed Mar. 16, 2010, and this application is also a continuation-in-part of U.S. application Ser. No. 13/092,027, filed Apr. 21, 2011, all three of which are incorporated herein by reference in their entirety.

BACKGROUND

The present invention relates generally to the field of engines. More specifically the present invention relates to systems for controlling the speed of engines.

An engine governor is used to help regulate engine speed, which is typically quantified in terms of the revolutions per minute (rpm) of the engine output shaft (e.g., crankshaft). The governor systems operate in one of three configurations: the governor is pneumatically controlled by the air cooling system of the engine, the governor is mechanically controlled by the crankshaft, or the governor senses a rate of electrical pulses of an ignition system of the engine. In each configuration, the engine speed is communicated to a portion of the engine that regulates fuel usage (e.g., throttle assembly), where if the engine is running too slow, fuel flow through the engine is increased, increasing the engine speed—and vice versa.

Typical engine governors experience a phenomenon called "droop," where a decrease in the engine speed occurs with an increase in loading of the engine. As a result of droop, an engine that is running without load operates at a higher speed than a fully loaded engine. By way of example, such a difference in engine speed may range from about 250 to 500 rpm between an unloaded and fully loaded engine. For example, the engine for a pressure washer may run at about 3750 rpm with no load, and at about 3400 rpm at full load.

The present invention relates generally to the field of carburetor systems. More specifically, the present invention relates to carburetor systems for engines configured to run outdoor power equipment, such as snow throwers.

Snow throwers and other types of outdoor power equipment are typically driven by an internal combustion engine. The engine includes a carburetor, which adds fuel to air flowing through the engine for combustion processes occurring within the engine. The carburetor includes a passageway through which air typically flows from an air cleaner or filter to a combustion chamber of the engine.

Along the passageway, the carburetor includes a venturi section having a constricted area, where the cross-sectional area orthogonal to the flow of air through the carburetor is reduced relative to portions of the passageway before and after the constricted area. The carburetor further includes a nozzle in or near the venturi section that is in fluid communication with fuel.

Constriction of the passageway through the venturi section increases the velocity of air passing through the constricted area, which generates low pressure at the nozzle. The low pressure pulls fuel through the nozzle and into the air. The fuel mixed with the air is then burned in the combustion chamber to power the engine, which in turn drives a crankshaft that powers the auger of the snow thrower.

SUMMARY

One embodiment of the invention relates to an engine including a carburetor including a variable venturi having a fixed surface and an adjustable surface that form a constricted section, wherein the adjustable surface is movable between a narrow position in which the constricted section has a first area and a wide position in which the constricted section has a second area larger than the first area, a venturi lever coupled to the adjustable surface and configured to move the adjustable surface between the narrow position and the wide position, a throttle valve downstream of the variable venturi and configured to be movable between a fully open position and a fully closed position to control a fluid flow through the carburetor, a throttle lever coupled to the throttle valve and configured to move the throttle valve, and an intake port in fluid communication with the fluid flow, a governor assembly including a governor configured to detect an engine speed of the engine, a governor arm coupled to the governor, the venturi lever, and the throttle lever, and a governor spring coupled to the governor arm to bias the throttle valve towards the fully open position, and a vacuum actuator including an actuator housing, a pressure-sensitive member positioned in the actuator housing and dividing the actuator housing into a vacuum side and an atmospheric side, an input port in fluid communication with the vacuum side of the actuator housing and in fluid communication with the intake port so an engine vacuum at the intake port is communicated to the vacuum side, an actuator linkage coupled to the governor spring and also coupled to the pressure-sensitive member for movement with the pressure-sensitive member in response to the engine vacuum, and an actuator spring biasing the actuator linkage to increase the tension on the governor spring.

Another embodiment of the invention relates to outdoor power equipment including a frame, wheels coupled to the frame, a fuel tank, an engine mounted to the frame wherein the engine includes a carburetor including a variable venturi having a fixed surface and an adjustable surface that form a constricted section, wherein the adjustable surface is movable between a narrow position in which the constricted section has a first area and a wide position in which the constricted section has a second area larger than the first area, a venturi lever coupled to the adjustable surface and configured to move the adjustable surface between the narrow position and the wide position, a throttle valve downstream of the variable venturi and configured to be movable between a fully open position and a fully closed position to control a fluid flow through the carburetor, a throttle lever coupled to the throttle valve and configured to move the throttle valve, and an intake port in fluid communication with the fluid flow, a governor assembly including a governor configured to detect an engine speed of the engine, a governor arm coupled to the governor, the venturi lever, and the throttle lever, and a governor spring coupled to the governor arm to bias the throttle valve towards the fully open position, and a vacuum actuator including an actuator housing, a pressure-sensitive member positioned in the actuator housing and dividing the actuator housing into a vacuum side and an atmospheric side, an input port in fluid communication with the vacuum side of the actuator housing and in fluid communication with the intake port so an engine vacuum at the intake port is communicated to the vacuum side, an actuator linkage coupled to the governor spring and also coupled to the pressure-sensitive member for movement with the pressure-sensitive member in response to the engine vacuum, and an actuator spring biasing the actuator linkage to increase the tension on the governor spring, and a rotating tool driven by the engine.

Another embodiment of the invention relates to a method of operating an engine including governing an engine speed to a top speed, applying a load to the engine, counteracting governor droop to maintain the engine speed at the top speed, increasing the load on the engine, and increasing a flow of fuel-air mixture through a carburetor in response to the increased load.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
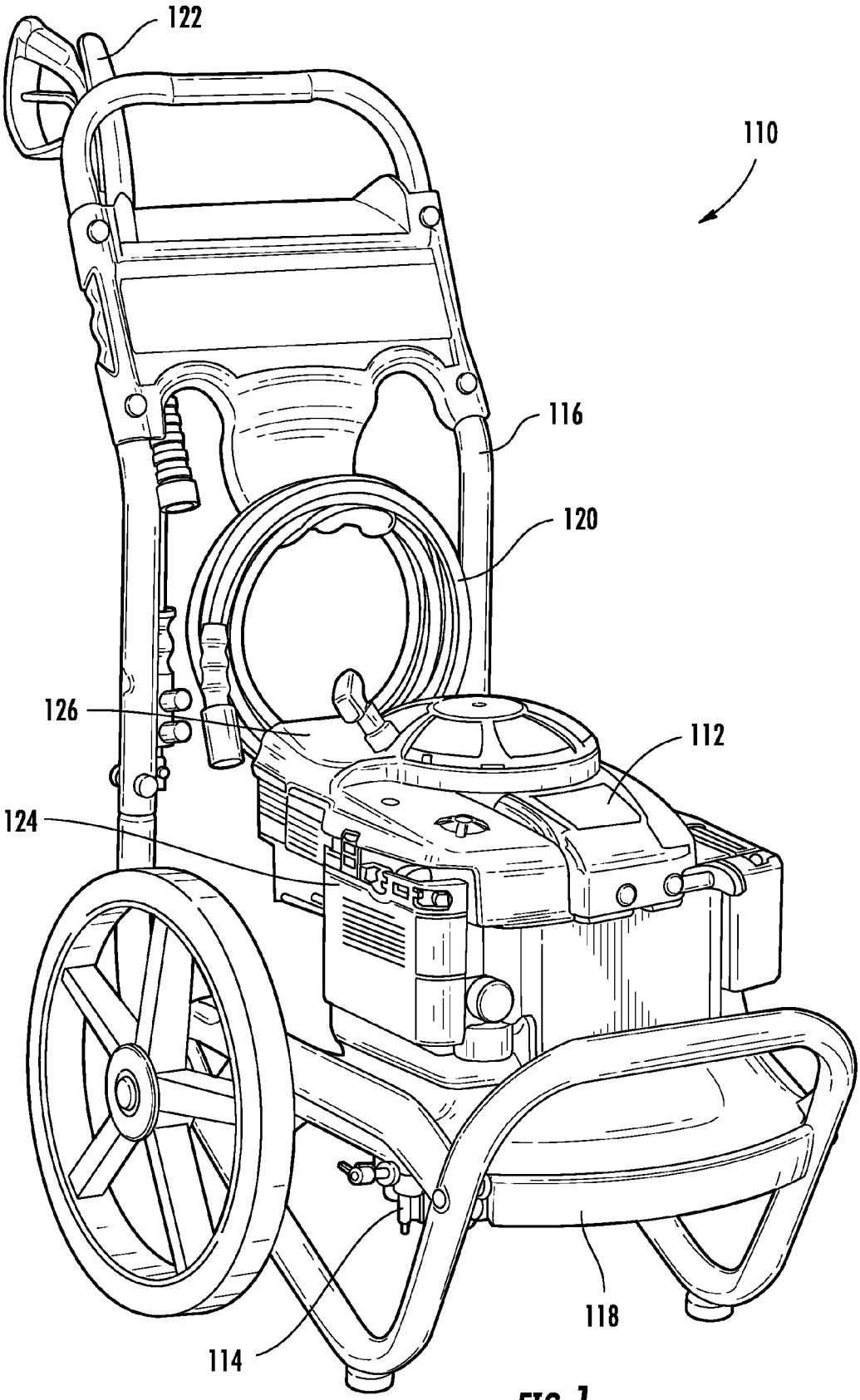
FIG. 1 is a perspective view of a pressure washer system according to an exemplary embodiment of the invention.

Referring to FIG. 1, power equipment in the form of a pressure washer 110 includes an engine 112 for driving a work implement in the form of a water pump 114 (e.g., triplex pump, axial cam pump, centrifugal pump). The engine 112 is supported by a frame 116 of the pressure washer 110, which includes a base plate 118 to which the engine 112 is fastened. Below the engine 112, the water pump 114 is also fastened to the base plate 118. A hose (not shown), such as a garden hose coupled to a faucet or other water source, may be used to supply water to an inlet of the water pump 114, which then pressurizes the water. A high pressure hose 120 may be connected to an outlet of the water pump 114, for receiving the pressurized water and delivering the water to a sprayer, such as a pressure washer spray gun 122.

Loading of the engine 112 of the pressure washer 110 varies as a function of whether the water pump 114 is actively pressurizing the water, is in a recirculation mode because the spray gun 122 is inactive, or is decoupled for the engine 112 (e.g., via an intermediate clutch). Further, the degree of loading of the engine 112 may vary with respect to which particular setting or nozzle is used by the spray gun 122 (e.g., high-pressure nozzle, high-flow-rate setting, etc.).

While the engine 112 is shown as a single-cylinder, four-stroke cycle, internal-combustion engine; in other contemplated embodiments diesel engines, two-cylinder engines, and electric motors may be used to drive work implements, such as a lawn mower blade, a drive train of a tractor, an alternator (e.g., generator), a rotary tiller, an auger for a snow thrower, or other work implements for various types of power equipment. In some embodiments, the engine 112 is vertically shafted, while in other embodiments an engine is horizontally shafted.

Figure 2:
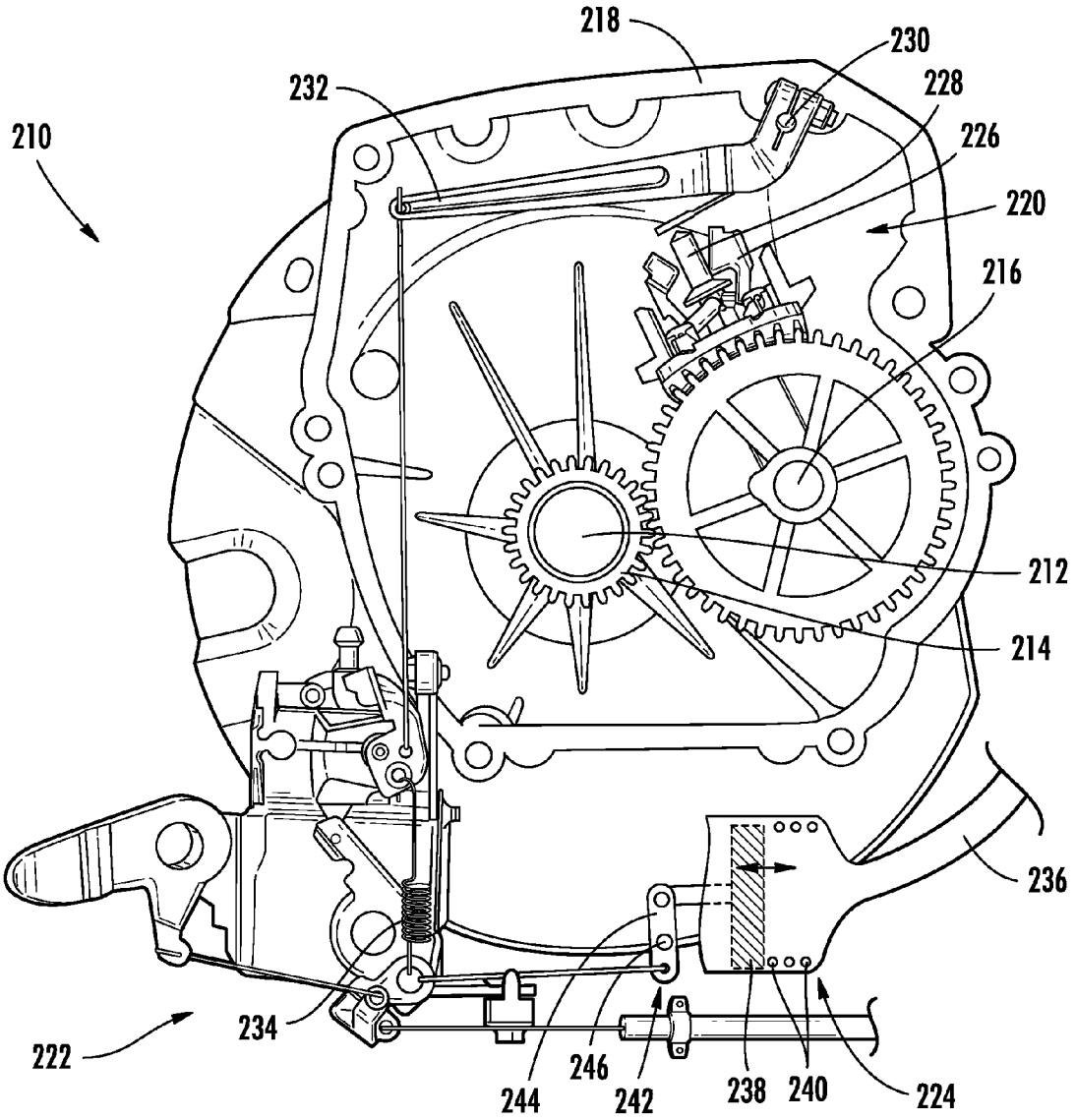
FIG. 2 is a sectional view an engine according to an exemplary embodiment of the invention.

Referring to FIG. 2, an engine 210 may be used to drive a pressure washer pump, or to drive a work implement for another form of power equipment. The engine 210 includes a crankshaft 212 having a timing gear 214, and a camshaft 216 rotationally coupled to the crankshaft 212 by way of the timing gear 214. The crankshaft 212 and camshaft 216 are both generally positioned within a crankcase 218 of the engine 210. A governor system 220 (e.g., mechanical governor) is coupled to the camshaft 216 and to the crankshaft 212, by way of the camshaft 216.

The governor system 220 is also coupled (e.g., mechanically linked) to a throttle assembly 222, and communicates the speed of the engine 210 to the throttle assembly 222. The engine 210 further includes an actuator 224 (e.g., supplementary governor, load-based governor input) coupled to the throttle assembly 222 that communicates the load (e.g., load level, loading, torque, etc.) experienced by the engine to the throttle assembly 222.

Figure 4:
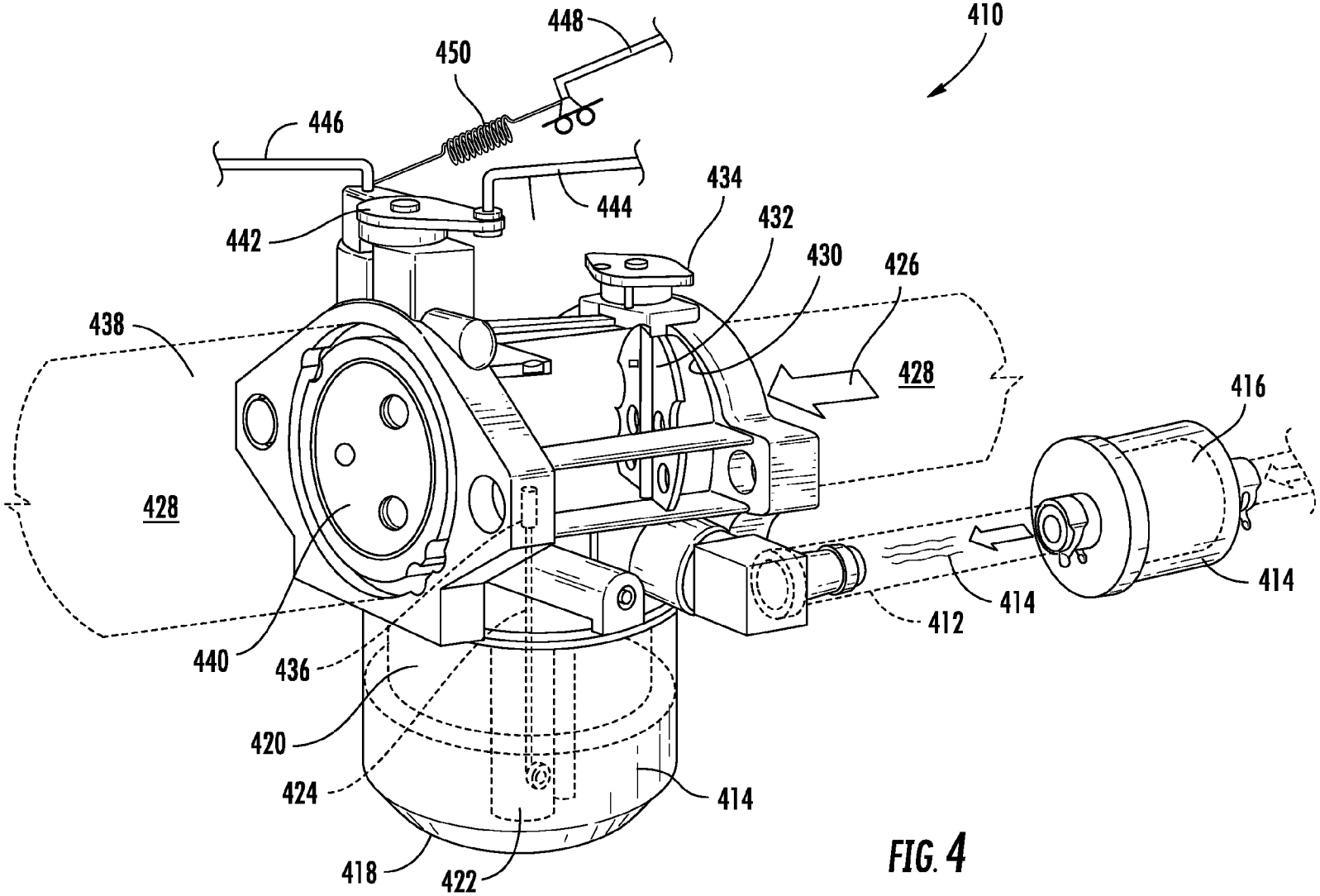
FIG. 4 is a perspective view of a carburetor system according to an exemplary embodiment of the invention.

According to an exemplary embodiment, the governor system 220 includes flyweights 226 coupled to the crankshaft 212 by way of the camshaft 216, and a governor cup 228 driven by movement of the flyweights 226. As the crankshaft 212 rotates faster, the flyweights 226 move outward, driving the governor cup 228 upward (e.g., forward, outward), and vice versa. A governor shaft 230 and/or governor arm 232 (e.g., throttle linkage) transfers movement of the governor cup 228 to a governor spring 234, used to bias a throttle plate (see, e.g., throttle plate 440 as shown in FIG. 4) of the throttle assembly 222. The throttle plate controls an opening (see, e.g., throat 430 of carburetor 410 as shown in FIG. 4) through which air and fuel is supplied to a combustion chamber (not shown) of the engine 210. As such, the governor system 220 at least partially controls the rate of fuel flowing through the engine 210, by manipulating the throttle assembly 222.

The actuator 224 is coupled to an interior portion of the engine 210 (e.g., intake manifold, interior of crankcase 218) via a conduit 236, which links (e.g., in fluid communication) the actuator 224 with the vacuum pressure of the engine 210 (e.g., ported pressure, manifold pressure). The vacuum pressure fluctuates as a function of engine load, such that engine vacuum decreases when loading of the engine 210 increases, and vice versa. The actuator 224 converts changes in the engine vacuum into a signal, which is then communicated to the throttle assembly 222.

According to the exemplary embodiment of FIG. 2, engine vacuum fluctuations are sensed by a plunger 238 (e.g. piston) within the actuator 224. The plunger 238 is biased by a spring 240, and moves a linkage 242 (e.g., mechanical linkage, such as a network of arms and levers, a pulley system, a Bowden cable, etc.; electrical linkage, such as a sensor coupled to a solenoid by wire). In some embodiments, the linkage 242 includes a member 244 that rotates about a fulcrum 246 (e.g., pivot point), converting forward motion on one end of the member 244 to rearward motion on an opposite end of the member 244.

The linkage 242 communicates movement of the plunger 238 to the throttle assembly 222, such as by loading the governor spring 234 (in addition to loads provided by the governor system 220), which is coupled to the throttle plate. The actuator 224 at least partially controls the rate of fuel flowing through the engine 210 by manipulating the throttle assembly 222. In other embodiments, the linkage 242 may be coupled to another plate (see, e.g., choke plate 432 as shown in FIG. 4), spring, or other fuel-flow controller, other than the governor spring 234 and throttle plate.

According to an exemplary embodiment, when engine vacuum pressure is low (e.g., such as with a heavy engine load), the actuator 224 increases force in the governor spring 234 of the throttle assembly 222, opening the throttle plate. Conversely, when engine vacuum is high, the actuator 224 reduces governor spring force. Accordingly, the engine 210 speeds up when increased load is present, and slows down when the load is removed, the control system of which may be referred to as a negative governor droop configuration or an on-demand governor system. The engine 210 increases engine speed with load and decreases speed with absence of load, which provides the user with an 'idle down' feature. In some embodiments, the engine 210 runs at about 2600 rpm without loading and about 3500 rpm (e.g., 3400-3700 rpm) at full load. The engine 210 of FIG. 2 is intended to run quieter at light engine loads, use less fuel at light to moderate engine loads, receive less engine wear, receive extended application life (e.g., extended water pump life), and produce greater useable power at full load.

Figure 3:
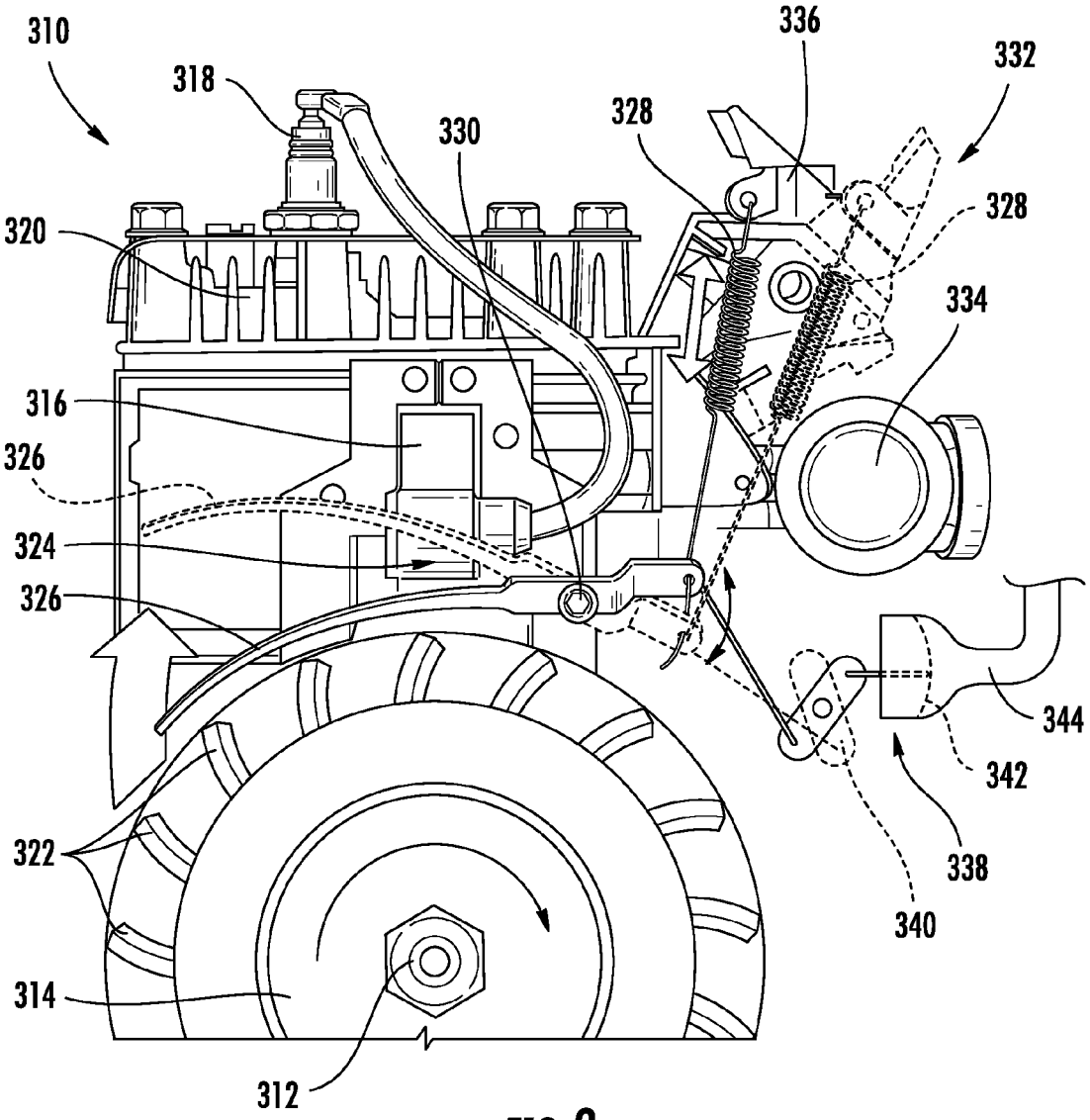
FIG. 3 is a sectional view an engine according to another exemplary embodiment.

Referring to FIG. 3, an engine 310 includes a crankshaft 312 with a flywheel 314 mounted to the crankshaft 312. Proximate to the flywheel 314, the engine includes an ignition system 316, which uses magnets (not shown) coupled to the flywheel 314 to generate timed sparks from a sparkplug 318, which extend through a cylinder head 320 of the engine 310, into a combustion chamber (not shown). The flywheel 314 includes fan blades 322 extending therefrom, which rotate with the crankshaft 312 and serve as a blower for air cooling the engine 310. The intensity of the blower is proportional to the rotational speed of the crankshaft 312.

The engine 310 further includes a pneumatic governor system 324, which includes an air vane 326 coupled to a governor spring 328. As the speed of the engine 310 increases, air from the fan blades 322 pushes the air vane 326, which rotates about a fulcrum 330 (e.g., pivot point). On the far side of the fulcrum 330, the air vane 326 is coupled to the governor spring 328, which is loaded by the movement of the air vane 326. Tension in the governor spring 328 biases the air vane 326, influencing movement of the throttle plate (see, e.g., throttle plate 440 as shown in FIG. 4) of a throttle assembly 332 toward a closed position, decreasing air and fuel flowing through a carburetor 334 to the combustion chamber of the engine 310, and thus reducing the engine speed. The governor spring 328 is further coupled to a throttle lever 336, which can be manually moved to alter tension in the governor spring 328.

Still referring to FIG. 3, the engine 310 also includes an actuator 338 that is coupled to the throttle assembly 332 by way of a linkage 340. The actuator 338 includes a diaphragm 342 that is positioned between air under engine vacuum pressure and air under atmospheric pressure. The vacuum side of the actuator 338 is not in fluid communication with atmospheric air. In some embodiments, one side of the diaphragm 342 is coupled to an intake manifold (e.g., conduit of air from the carburetor to the combustion chamber) of the engine via a conduit 344. The linkage 340 receives movement of the diaphragm 342 and communicates the movement to the throttle assembly 332 by loading (e.g., tensioning, relaxing) the governor spring 328. As such the actuator 338 at least partially controls the rate of air/fuel flowing through the carburetor, by manipulating the throttle assembly 332.

Referring to FIG. 4, an engine (see, e.g., engines 112, 210, 310 as shown in FIGS. 1-3) may use a carburetor 410 to introduce fuel 414 into air 426 flowing from an air intake (see, e.g., intake 124 as shown in FIG. 1) to a combustion chamber of the engine. A fuel line 412 supplies the fuel 414 (e.g., gasoline, ethanol, diesel, alcohol, etc.) from a fuel tank (see, e.g., fuel tank 126 as shown in FIG. 1), through a fuel filter 416, and to a float bowl 418 of the carburetor 410. The fuel level (e.g., quantity) in the float bowl 418 is regulated by a float 420 coupled to a valve (not shown) along (e.g., in series with) the fuel line 412.

Fuel 414 is delivered from the float bowl 418 up through a pedestal 422 along a main jet 424 of the carburetor 410. Simultaneously, air 426 passes from the air intake to a throat 430 of the carburetor 410. Air passes into the carburetor 410, past a choke plate 432. A choke lever 434 may be used to turn the choke plate 432 so as to block or to allow the air 426 to flow into the carburetor 410. The air 426 passes through the throat 430 with a positive velocity, and passes the main jet 424 at a lower pressure than the air of the float bowl 418 (under atmospheric air pressure). As such the fuel 414 is delivered through the main jet 424 and into the air 426 passing through a nozzle 436 (e.g., venturi) in the carburetor 410.

The fuel and air mixture 438 then flows out of the carburetor 410. However, the fuel and air mixture 438 passes a throttle plate 440 as the fuel and air mixture 438 is flowing out of the carburetor 410. When the throttle plate 440 is fully open (i.e., turned so as to minimally interfere with the fuel and air mixture 438), a maximum amount of the fuel and air mixture 438 is allowed to pass to the combustion chamber. However, as the throttle plate 440 is turned (e.g., closed) so as to impede the fuel and air mixture 438, a lesser amount of the fuel and air mixture 438 is allowed to pass to the combustion chamber. Operation of the throttle plate 440 is controlled by a throttle lever 442.

Figure 7:
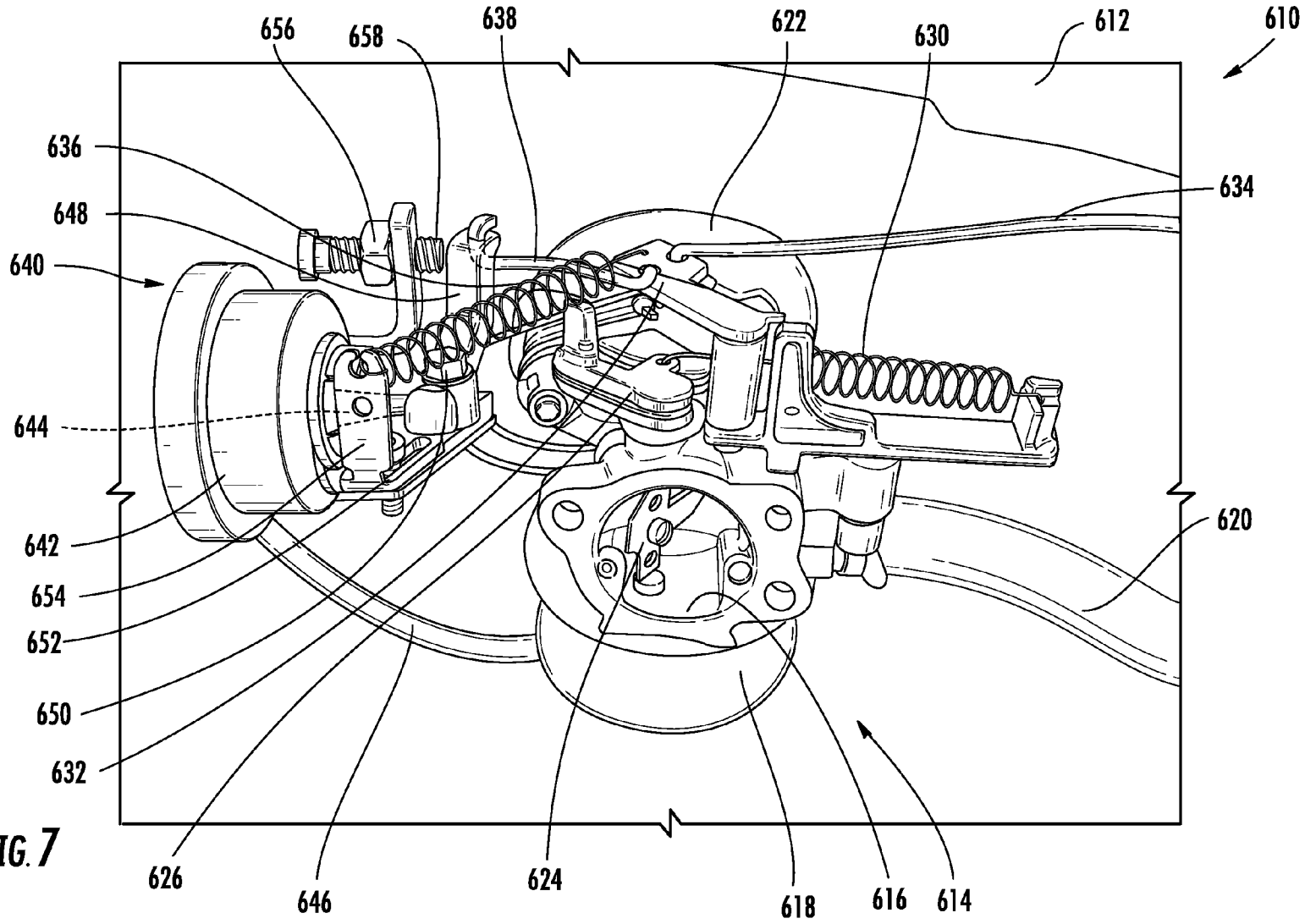
FIG. 7 is a perspective view of a portion of an engine according to yet another exemplary embodiment of the invention.

According to an exemplary embodiment, the throttle lever 442 is at least partially controlled by a first linkage 444 coupled to a governor system (see, e.g., governor system 220 as shown in FIG. 2), which loads the throttle lever 442 as a function of the speed of the engine. The throttle lever 442 is further at least partially controlled by a second linkage 446 coupled to an actuator (see, e.g., actuator 640 as shown in FIG. 7), which loads the throttle lever 442 as a function of the load level of the engine. The throttle lever 442 is still further at least partially controlled by a third linkage 448 coupled to a manual throttle control lever (see, e.g., throttle lever 336 as shown in FIG. 3), which adjusts tension in a governor spring 450 coupled to the throttle lever 442. During some uses of the engine, it is contemplated that one or more of the linkages 444, 446, 448 may apply little or no force to the throttle lever 442, while one or more others of the linkages 444, 446, 448 substantially control movement of the throttle lever 442, and therefore the movement of the throttle plate 440. In other embodiments, the relative positions of the linkages 444, 446, 448 and the governor spring 450 may be otherwise arranged in relation to the throttle lever 442.

While embodiments shown in the figures show engines incorporating carburetors for controlling the insertion of fuel into air that is delivered to the engine for combustion purposes, in other contemplated embodiments, commercially-available fuel injection systems may be used in place or in conjunction with carburetors. In such embodiments, the rate of fuel injected may be at least partially controlled by a governor as a function of engine speed, and at least partially controlled by an actuator that is sensitive to engine vacuum pressure.

Figure 5:
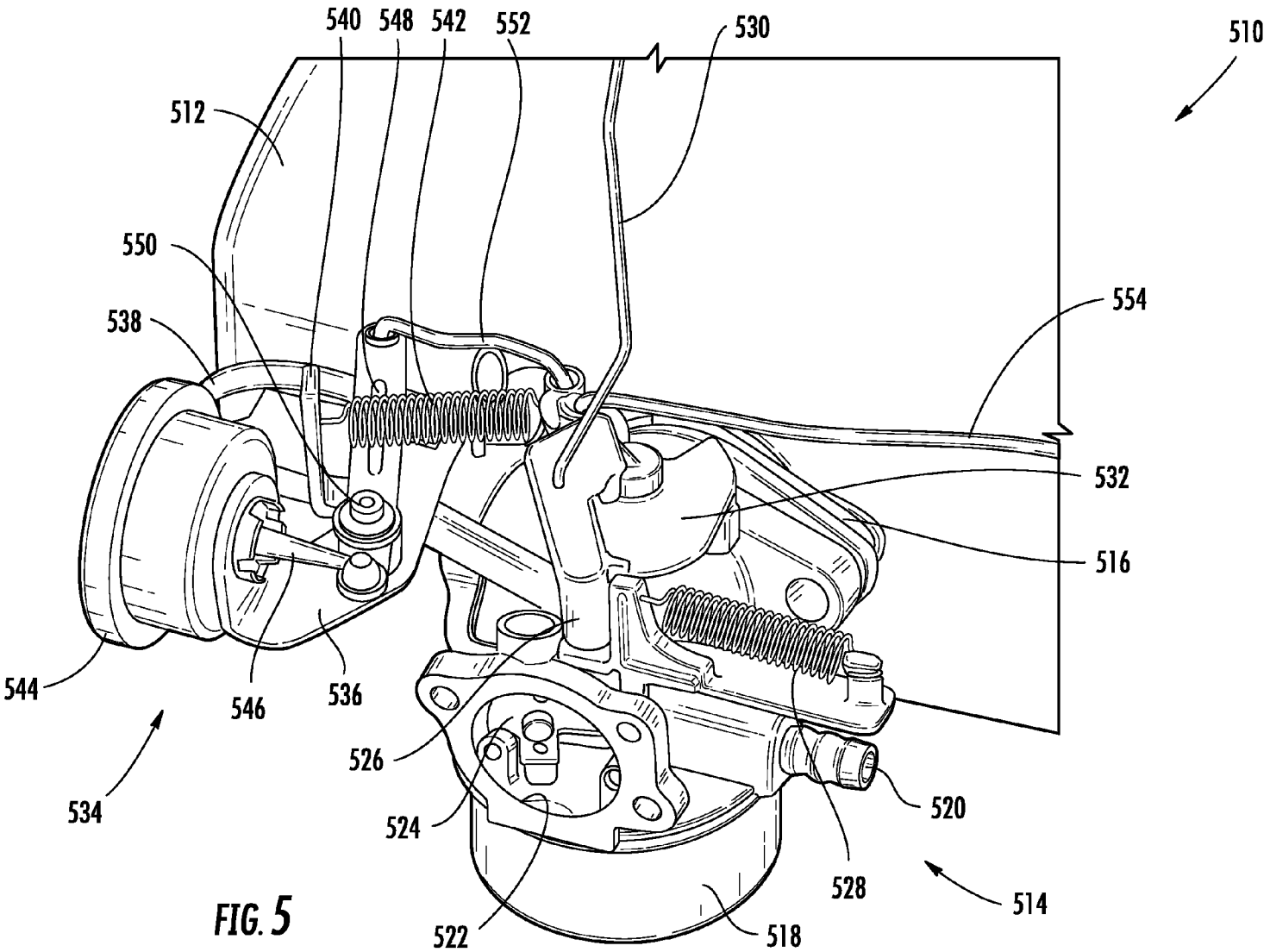
FIG. 5 is a perspective view of a portion of an engine according to an exemplary embodiment of the invention.

Referring now to FIG. 5, an engine 510 includes a crankcase 512, a carburetor 514, and an intake manifold 516 directing air and fuel into a combustion chamber (not shown) within the crankcase 512. The carburetor 514 includes a float bowl 518, a fuel line 520, and a throat 522 through which air flows to receive fuel from a venturi nozzle (see, e.g., nozzle 436 as shown in FIG. 4). The carburetor 514 further includes a choke plate 524 coupled to a choke lever 526 for rotating the choke plate 524 relative to the throat 522. A choke spring 528 (e.g., ready-start choke spring) and a choke linkage 530 are each coupled to the choke lever 526, for manipulating the choke plate 524. The carburetor 514 still further includes a throttle plate (see, e.g., throttle plate 440 as shown in FIG. 4) coupled to a throttle lever 532 for rotating the throttle plate relative to the throat 522.

Figure 9:
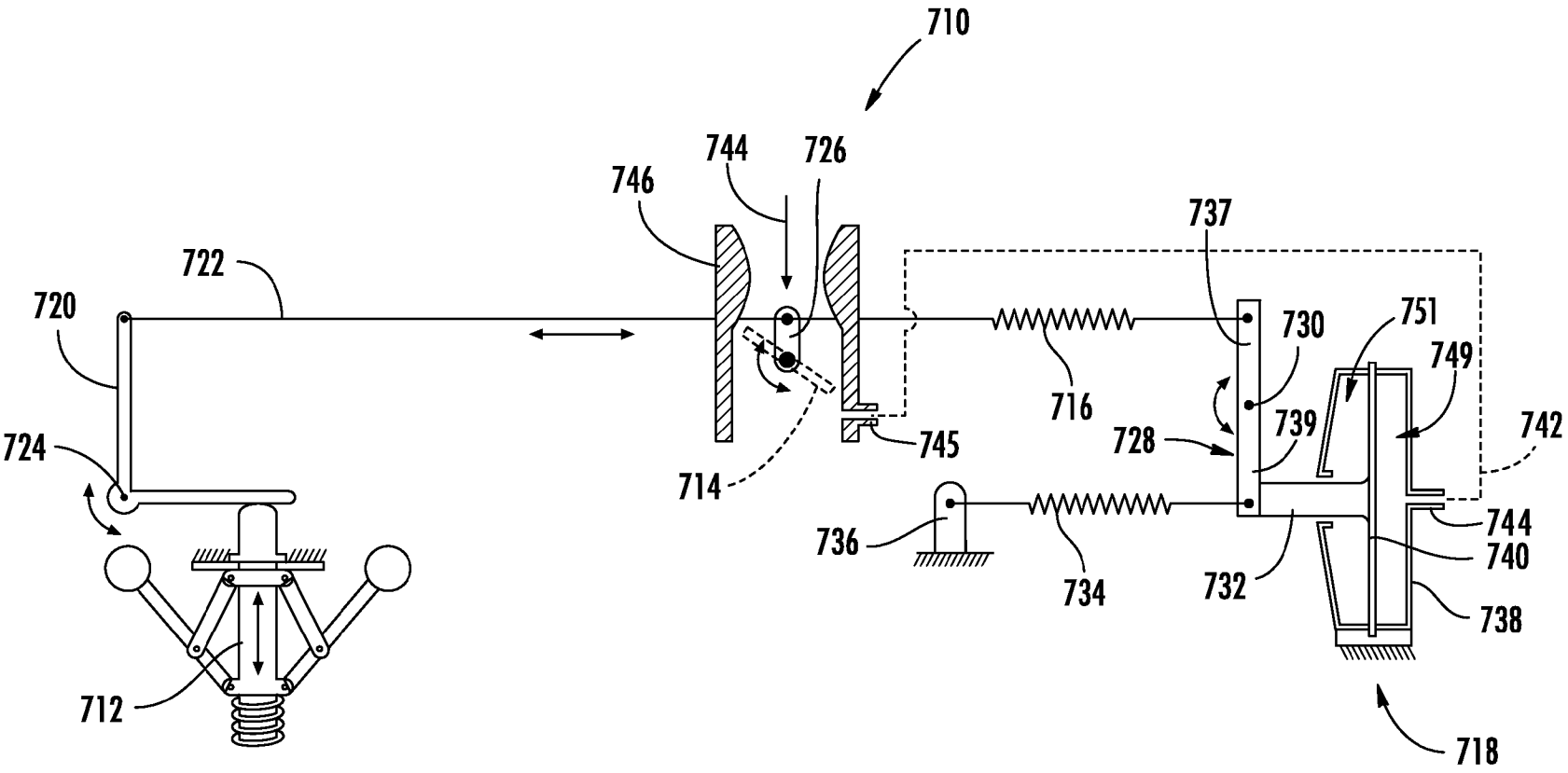
FIG. 9 is a schematic diagram of a control system according to an exemplary embodiment of the invention.

An actuator 534 is fastened to a bracket 536 and coupled to the intake manifold 516 of the engine 510 by way of a conduit 538 (e.g., rubber hose, metal piping). The bracket 536 additionally includes a tang 540 extending therefrom to which a governor spring 542 is coupled, which biases the throttle lever 532. The actuator 534 includes a housing 544 surrounding a pressure-sensitive member (see, e.g., diaphragm 740 as shown in FIG. 9, and plunger 238 as shown in FIG. 2) that moves a rod 546 in response to changes in engine vacuum. The rod 546 is connected to a pivot arm 548 that rotates about a fulcrum 550, and moves a linkage 552 (e.g., idle-down link) that is coupled to the throttle lever 532. A governor linkage 554 connects the throttle lever 532 to a governor system (see, e.g., governor system 220 as shown in FIG. 2) of the engine 510.

Increased loading on the engine 510 decreases the engine vacuum pressure in the intake manifold 516, which is relayed to the actuator 534 by way of the conduit 538. The actuator 534 moves the rod 546 in response to the change in engine vacuum, which rotates the pivot arm 548 about the fulcrum 550. Rotation of the pivot arm 548 is communicated to the throttle lever 532 by way of the linkage 552. Force applied by the linkage 552 on the throttle lever 532 is either enhanced, countered, or not affected by forces applied to the throttle lever 532 by the governor spring 542 and the governor linkage 554. The sum force (e.g., net force, cumulative force) on the throttle lever 532 rotates the throttle plate, which at least partially controls the flow of fuel and air through throat 522 of the carburetor 514 to adjust the engine speed.

Figure 6:
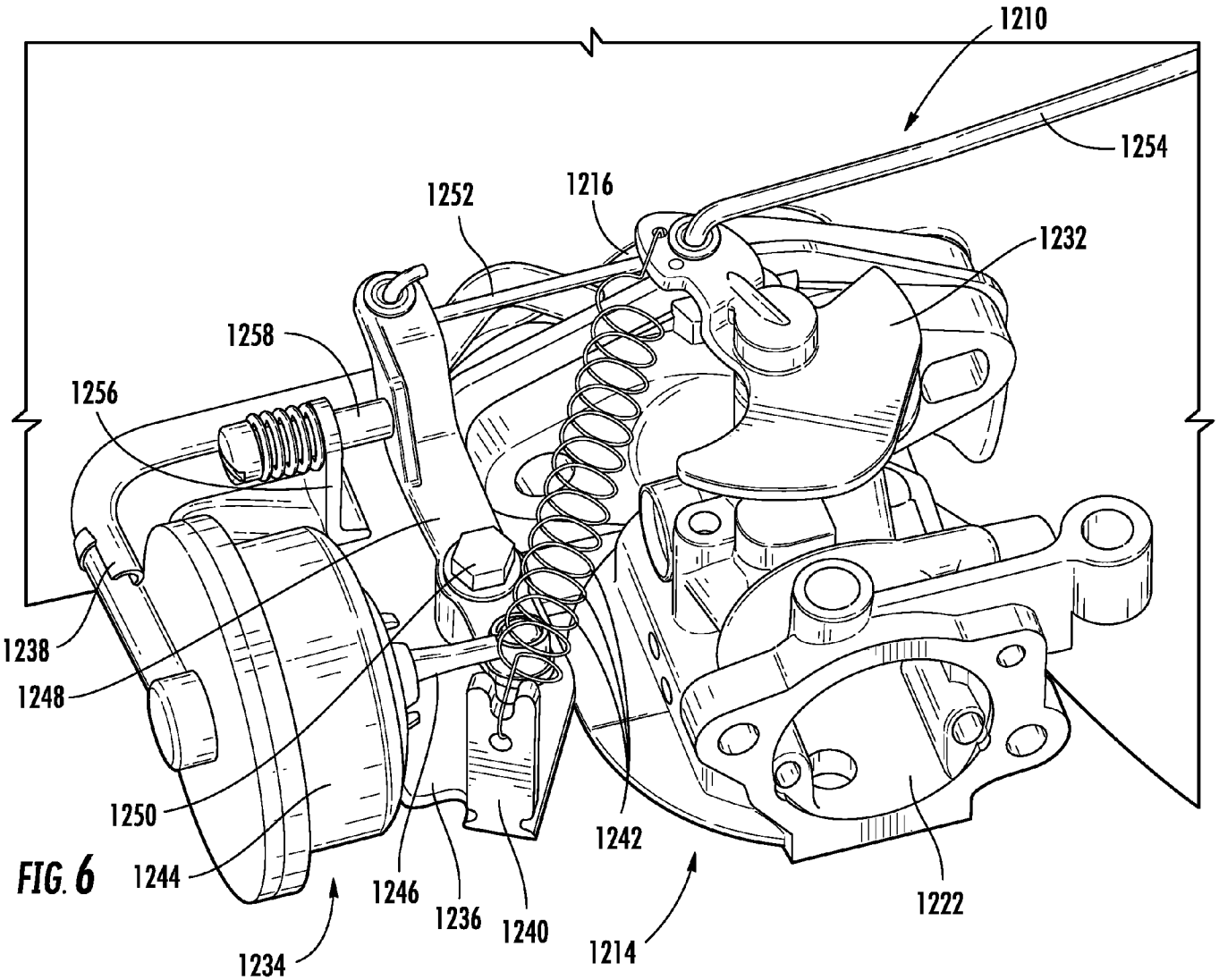
FIG. 6 is a perspective view of a portion of an engine according to another exemplary embodiment of the invention.

Referring to FIG. 6, a speed-control system 1210 for a combustion engine includes a carburetor 1214 and a pressure-sensitive actuator 1234. The actuator is coupled to an intake manifold 1216 or other portion of an engine, such that the actuator 1234 experiences pressure fluctuations of the engine that are produced as a function of load on the engine. According to an exemplary embodiment, a housing 1244 of the actuator 1234 is coupled to the intake manifold 1216 by way of a conduit 1238 (e.g., rubber hose). Pressure fluctuations are transferred from the actuator 1234 to a rod 1246 that moves a lever arm 1248 about a fulcrum 1250 to move a linkage 1252 coupled to a throttle lever 1232, controlling a flow rate of air through a throat 1222 of the carburetor 1214. Movement of the lever arm 1248 is limited by an adjustable backstop 1258. A governor linkage 1254 is also coupled to the throttle lever. A governor spring 1242 biases the throttle lever 1232, and extends to a tang 1240 of a bracket 1236 that supports the actuator 1234.

According to at least one embodiment, interaction between a pressure-sensitive actuator (see, e.g., actuator 1234 as shown in FIG. 6) and a throttle plate (see, e.g., throttle plate 440 as shown in FIG. 4) are directly related (e.g., proportional, linearly related) through a chain of connected components (e.g., gear train, mechanical linkage, etc.) such that any change in pressure sensed by the actuator is applied to the throttle plate to some degree, in combination with other forces acting on the throttle plate (e.g., governor spring, throttle linkage, etc.). For example, it is contemplated that such an embodiment may include damping (e.g., restrictors, dampers, etc.) that attenuates small pressure changes and noise, but that such an embodiment does not include slack or slop (e.g., excess degrees of freedom) in the chain of connected components that allows for movement of the actuator that is not at all relayed throttle plate, such as free movement of a lever arm or linkage within a bounded open space or slot. It is believed that such a direct relationship between actuator and throttle plate, when combined with controlled damping of noise, improves responsiveness of the throttle system (and also engine efficiency), saving fuel and extending life of engine components.

Figure 8:
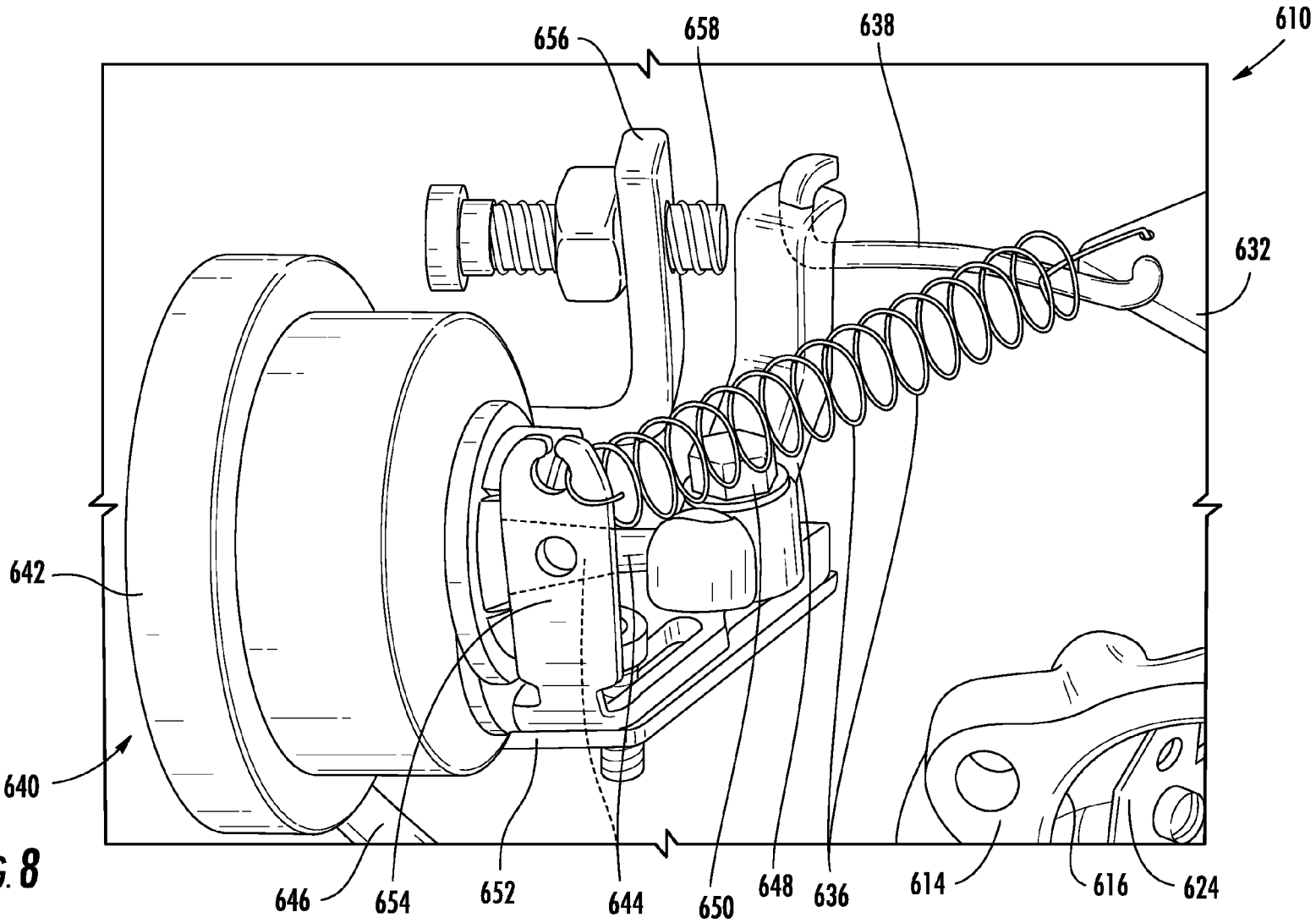
FIG. 8 is an enlarged view of the engine of FIG. 7.

Referring to FIGS. 7-8, an engine 610 may be used to drive power equipment, such as a riding lawn mower 612. The engine 610 includes a carburetor 614 having a throat 616 and a float bowl 618. A fuel line 620 directs fuel to the float bowl 618 of the carburetor 614 from a fuel tank (see, e.g., fuel tank 126 as shown in FIG. 1). The throat 616 is coupled to (integral with, adjacent to, etc.) an intake manifold 622 of the engine 610. The carburetor 614 further includes a choke plate 624 joined to a choke lever 626, which is at least partially controlled by both a choke linkage and/or a choke spring 630. The carburetor 614 still further includes a throttle plate (see, e.g., throttle plate 440 as shown in FIG. 4), which may be used to control the flow of fuel and air through the carburetor 614. The throttle plate is joined to a throttle lever 632, which is at least partially controlled by a governor linkage 634, a governor spring 636, and a linkage 638 from an actuator 640.

The actuator 640 includes a housing 642 at least partially surrounding a pressure-sensitive member therein. The pressure-sensitive member drives a rod 644 as a function of engine vacuum pressure, which is sensed by the pressure-sensitive member of the actuator 640 by way of a conduit 646 coupled to the housing 642. When vacuum pressure of the engine 610 changes, the rod 644 rotates a lever arm 648 about a fulcrum 650, which moves the linkage 638, applying force to the throttle plate. The force of the linkage 638 is either complemented or opposed by either or both of the governor spring 636 and the governor linkage 638. As such, the net force applied to the throttle lever 632 controls the orientation of the throttle plate in the carburetor 614, at least partially controlling the flow of fuel and air through the engine 610.

The actuator 640 is supported by a bracket 652 coupled to the engine 610, where the bracket 652 includes a tang 654 extending therefrom, which supports an end of the governor spring 636. The bracket 652 further includes an extension 656 (e.g., portion, piece coupled thereto, etc.) through which a backstop 658 (e.g., high-speed throttle stop) extends. The backstop 658 may be used to limit movement of the lever arm 648, thereby limiting the maximum amount of movement that the linkage 638 applies to the throttle lever 632. According to an exemplary embodiment, the backstop 658 is adjustable, such as by a threaded coupling with the extension 656 of the bracket 652. In other embodiments, other limiters or backstops may be added to the engine 610 to further or otherwise limit movement of the linkage 638.

While the linkage 638 provides communication between the actuator 640 and the throttle plate, it is contemplated that such an actuator may otherwise control the flow of air and fuel through the engine. In some contemplated embodiments, the actuator may be linked to a valve to control the rate of fuel flowing from through a main jet or venturi nozzle in the carburetor (see, e.g., carburetor 410 as shown in FIG. 4). In other contemplated embodiments, the actuator may be linked to an adjustable restrictor or damper to control the flow rate of air through the throat and/or portions of the intake manifold. In some other contemplated embodiments, the actuator may be coupled to a frictional damper, coupled to the rod 644, the lever arm 648, or other portions of the engine 610, between the manifold 622 and the throttle plate (or other fuel injector). In still other contemplated embodiments, mass or length may be added to (or removed from) the lever arm 648 to dampen movement thereof, such as via mass, moment, and/or inertia to oppose or mitigate the effect of vibratory noise.

Referring to FIG. 9, a control system 710 for controlling the speed of an engine includes a governor 712 coupled to a throttle plate 714, a governor spring 716 opposing movement of the governor 712, and a vacuum actuator (shown as actuator 718) coupled to the throttle plate 714. According to an exemplary embodiment, the control system 710 further includes a governor arm 720 and a governor linkage 722. The governor 712 rotates the governor arm 720 about a fulcrum 724 as a function of a sensed change in engine speed, which pulls or pushes the governor linkage 722. The governor linkage 722 is coupled to a throttle lever 726 (and/or to a throttle shaft), and is opposed by the governor spring 716. As such, movement of the governor linkage 722 overcomes bias in the governor spring 716, rotating the throttle lever 726, and accordingly rotating the throttle plate 714 attached thereto. The throttle plate 714 is movable between multiple positions, including fully open at one extreme and fully closed at the other extreme. The position of the throttle plate 714 adjusts a fluid flow (shown as air flow 744) from the carburetor to a combustion chamber of the engine.

Still referring to FIG. 9, the governor spring 716 is further coupled to a pivoting member 728 (e.g., lever) rotatable about a fulcrum 730, the position of which may be adjustable along the pivoting member 728 in some contemplated embodiments. Opposite the governor spring 716 on the pivoting member 728, the actuator 718 includes a rod 732 coupled to the pivoting member 728. According to an exemplary embodiment, movement of the rod 732 is opposed by an actuator spring (shown as spring 734), the tension of which may be adjustable (e.g., able to be set) in some contemplated embodiments, such as by moving a bracket 736 to which the spring 734 is coupled. The bracket 736, even though movable in some embodiments to adjust the tension of the spring 734, is considered to be a fixed attachment point because the bracket 736 is not configured to move during normal operation of the engine. The pivoting member 728 includes two arms 737 and 739 with the fulcrum 730 located between the two arms 737 and 739. The governor spring 716 is coupled to the first arm 737. The rod 732 and the spring 734 are both coupled to the second arm 739

The actuator 718 includes a housing 738 and a diaphragm 740 (or other pressure-sensitive member) therein, which is coupled by way of a conduit 742 to a fluid flow (shown as air flow 744 with the direction of flow indicated by the arrow), the coupling of which may be before, during, or after the air travels through a carburetor 746 or other fuel injection system. As shown in FIG. 9, the conduit 742 is fluidly connected to the air flow 744 via an intake port 745 in the carburetor 746 at a location downstream of the throttle plate 714 relative to the direction of the air flow 744. The actuator 718 also includes an input port 747 to which the conduit 742 connects. The diaphragm 740 divides the actuator housing 738 into a vacuum side 749 and an atmospheric side 751. The input port 747 opens into the vacuum side 749 to establish fluid communication between the air flow 744. Therefore, the vacuum side 749 is in fluid communication with the engine vacuum pressure at the intake port 745 via the conduit 742 and the input port 747. The atmospheric side 751 is in fluid communication with atmosphere. The diaphragm is located a neutral position when the pressure in the vacuum side 749 is equal to the pressure in the atmospheric side 751 (i.e., atmospheric pressure). The diaphragm 740 moves toward the side 749 or 751 at the lower pressure. The amount of movement of the diaphragm 740 is proportional to the pressure difference between the two sides 749 and 751. Accordingly, changes in engine vacuum pressure are sensed by the diaphragm 740, which moves the rod 732, which rotates the pivoting member 728, which adjusts tension in the governor spring 716, at least partially controlling movement of the throttle plate 714. As shown in FIG. 9, the rod 732 extends from the diaphragm 740, through the atmospheric side 751, and out of the housing 738.

The particular relative positions of the governor linkage 722, the governor spring 716, the pivoting member 728, the rod 732, the intake port 745 (e.g., upstream of the throttle plate 714 for ported vacuum or downstream of the throttle plate 714 for manifold vacuum), the input port 747 (e.g., on one side of the diaphragm 740 or on the other side of the diaphragm 740) and/or other components of the control system 710 may be otherwise arranged in some embodiments. In still other embodiments, components of the control system 710 may be omitted, such as the pivoting member 728, depending upon the arrangement of the other components of the control system 710. The components are arranged such that under heavy loads on the engine, the force applied by the actuator 718 and related components (e.g., the governor spring 716, the pivoting member 728, the rod 732) on the throttle lever 726 opposes the force applied to the throttle lever 726 by the governor 712, so that the throttle lever 726 rotates to open the throttle plate 714. In contemplated embodiments, the diaphragm (or other pressure-sensitive member) may be mounted directly to, adjacent to, or proximate to the intake manifold or crankcase of an engine. In such embodiments, changes in engine vacuum may be communicated to a governor spring 716 or other portion of a throttle assembly from the diaphragm by way of a Bowden cable or other linkage.

Figure 10:
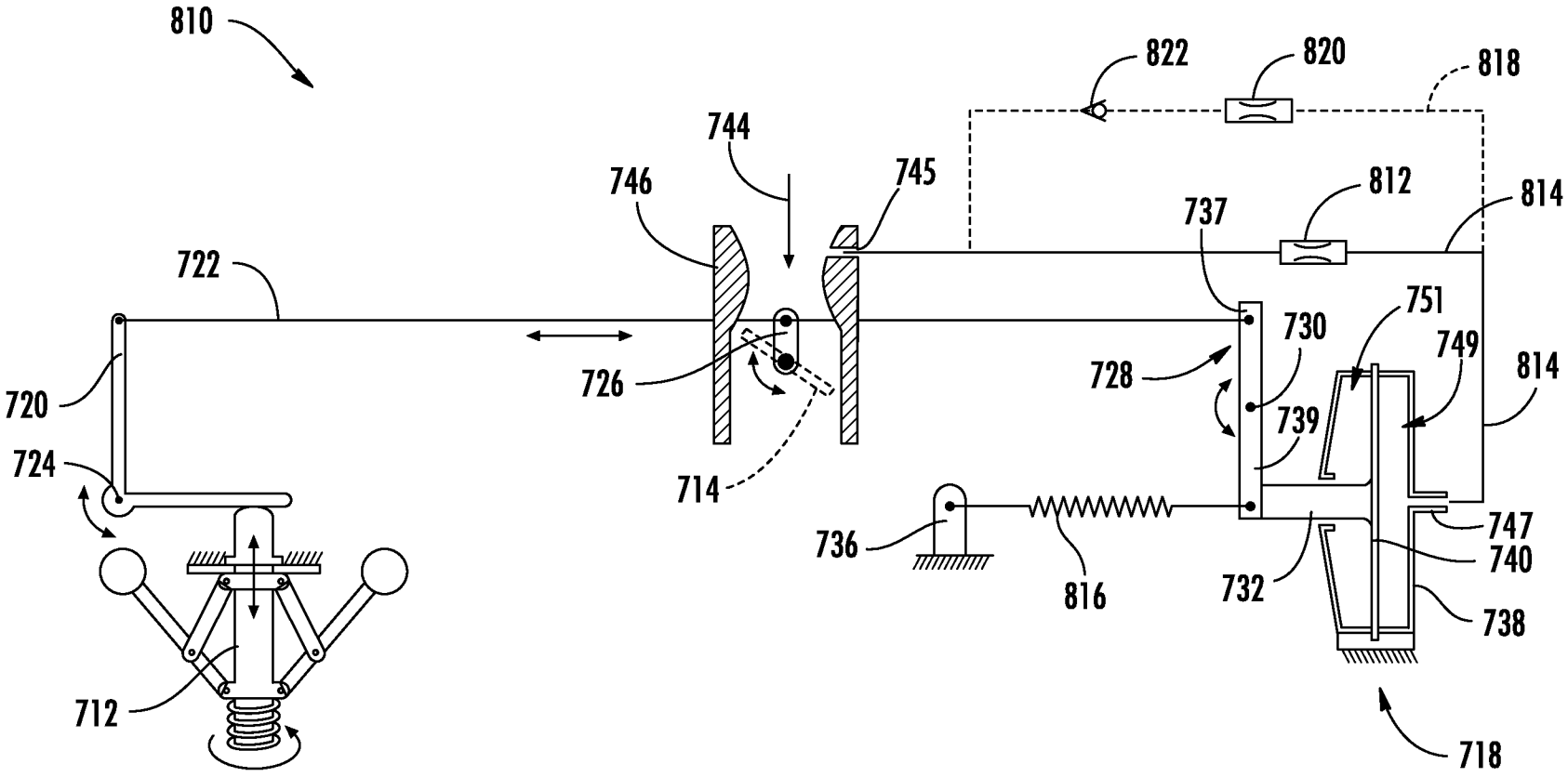
FIG. 10 is a schematic diagram of a control system according to another exemplary embodiment of the invention.

Referring to FIG. 10, a control system 810 for an engine including some components included in the control system 710, further includes a restrictor 812 (e.g., pneumatic damper, pneumatic valve) positioned along a first conduit 814 extending between the actuator 718 and the air flow 744. As shown in FIG. 10, the first conduit 814 is fluidly connected to the air flow 744 via the intake port 745 in the carburetor 746 at a location upstream of the throttle plate 714 relative to the direction of the air flow 744. In some embodiments, the restrictor 812 is narrowed or higher-friction portion of the conduit 814 that is believed by the Applicants to dampen noise (e.g., temporally short fluctuations of pressure as a result of piston cycles) in engine vacuum that may not be related to the load level of the engine. The control system 810 includes a governor spring 816 positioned on the pivoting member 728, on the same side of the fulcrum 730 as the rod 732 of the actuator 718.

Still referring to FIG. 10, the control system 810, in some embodiments, further includes a second conduit 818 extending in parallel with the first conduit 814 (cf. in series with), between the actuator 718 and the air flow 744. The second conduit 818 includes a restrictor 820, which may produce a different magnitude of air flow restriction when compared to the restrictor 812 of the first conduit 814. In such embodiments, at least one check valve 822 is positioned in at least one of the first and second conduits 814, 818 such that air flow is directed through one of the restrictors 812, 820 when blocked from the other of the restrictors 812, 820 by the check valve 822. However, in other embodiments, one or both restrictors 812, 820 dampen pressure pulses, and do not require a device to bias the flow direction such as a check valve.

Use of separate first and second conduits 814, 818 arranged in parallel with each other, each having one of the restrictors 812, 820, and at least one check valve 822 positioned along one of the first and second conduits 814, 818, is intended to allow for independent control of overshoot- and undershoot-type responses of the control system 810 to changes in engine vacuum.

Figure 11:
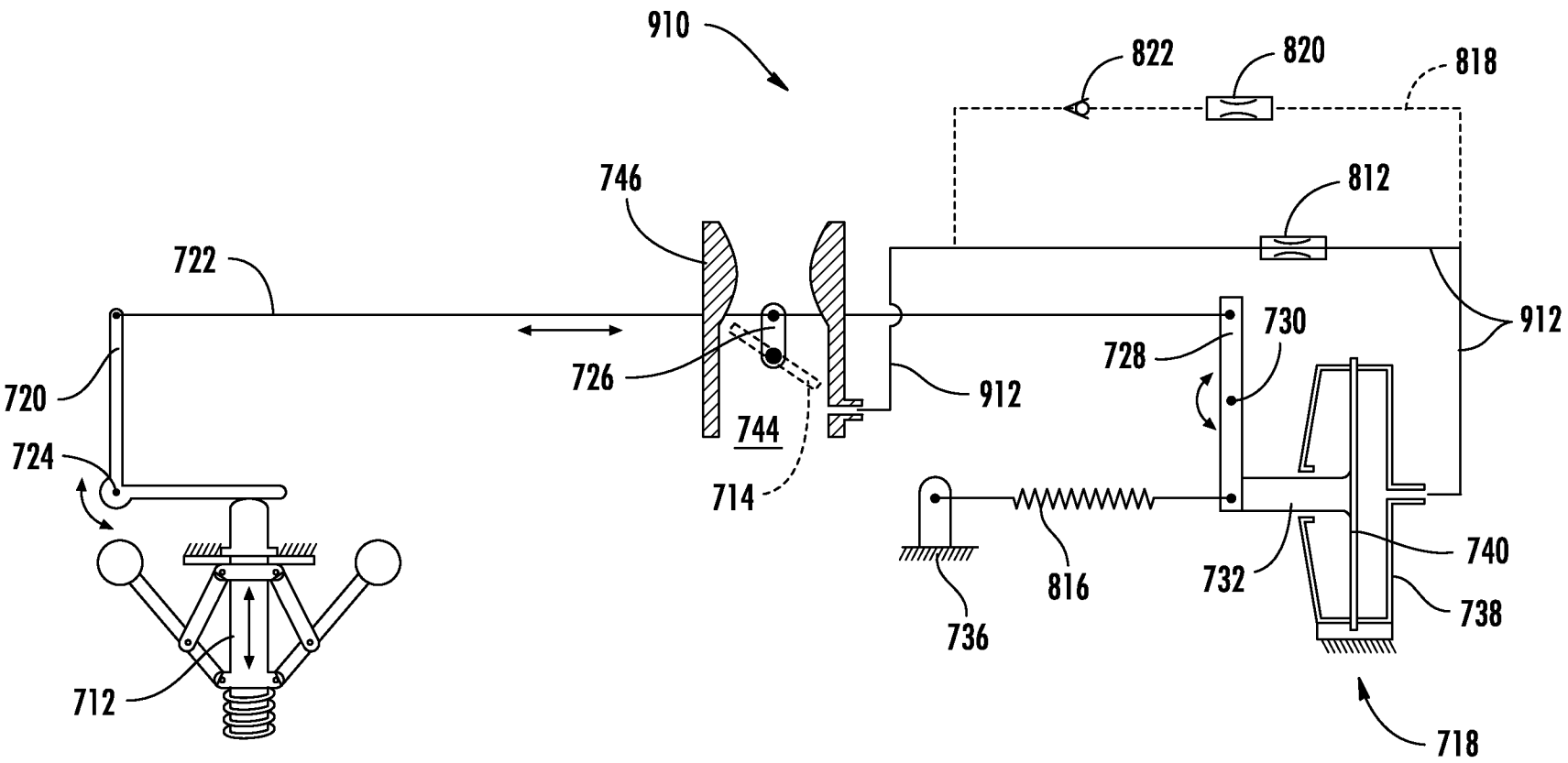
FIG. 11 is a schematic diagram of a control system according to yet another exemplary embodiment of the invention.

Referring to FIG. 11, a control system 910 for an engine including some components included in the control systems 710, 810, further includes a first conduit 912 that connects the actuator 718 to the air flow 744 after the air flow 744 has passed through the throttle plate 714, which is believed to improve efficiency of the control system 910 by reducing overshoot- and undershoot-type responses. The conduit 912 of control system 910 connects downstream of the throttle plate 714 (e.g., throttle valve), which changes the type of vacuum experienced by the actuator when compared to the vacuum experienced by the conduit 814 of system 810, which relies upon ported vacuum, as opposed to manifold vacuum. Applicants believe that ported vacuum grows (pressure decreases relative to atmospheric) with increased opening of the throttle plate 714 while manifold vacuum decreases as the throttle plate 714 opens.

Figure 12:
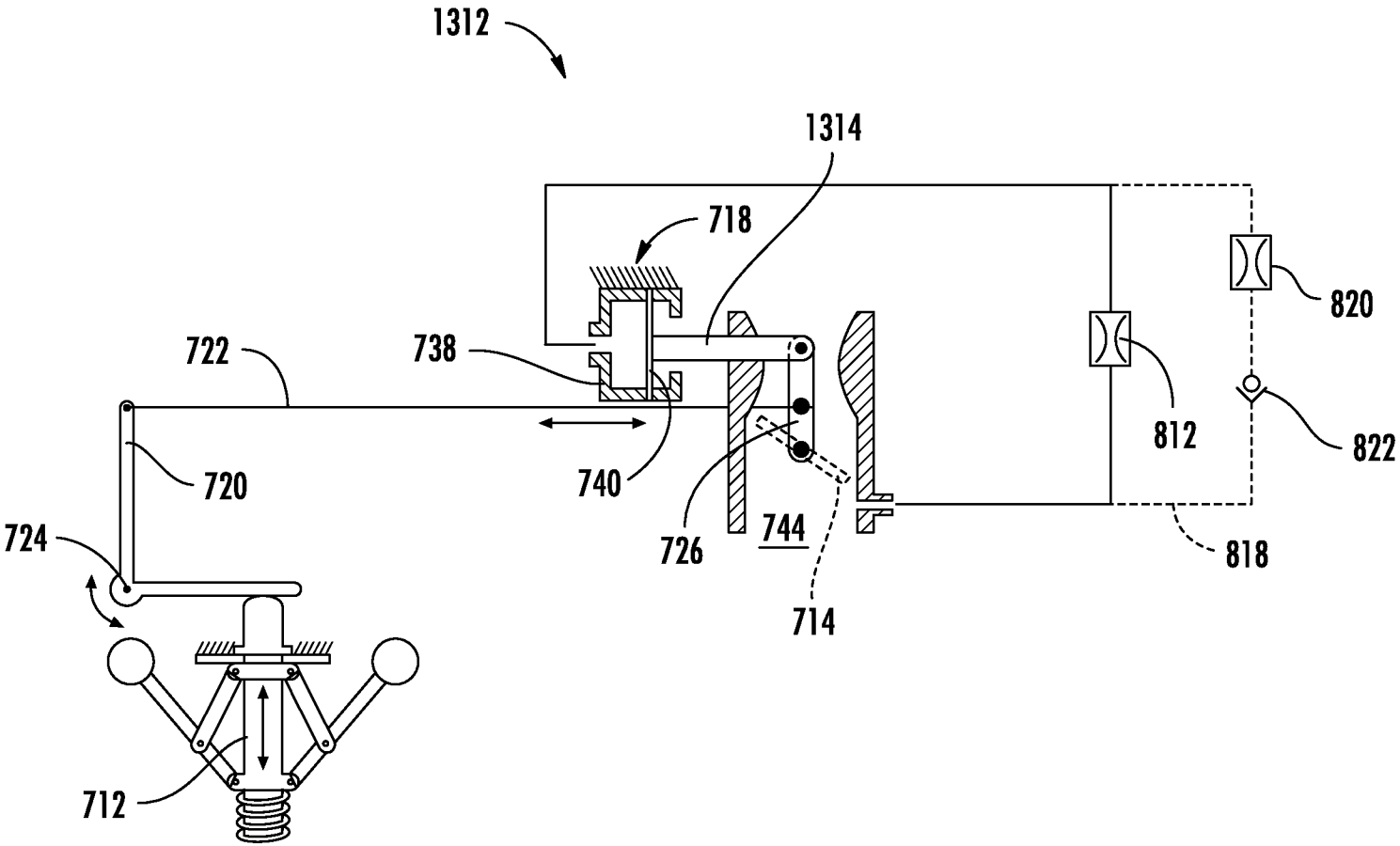
FIG. 12 is a schematic diagram of a control system according to another exemplary embodiment of the invention.
Figure 13:
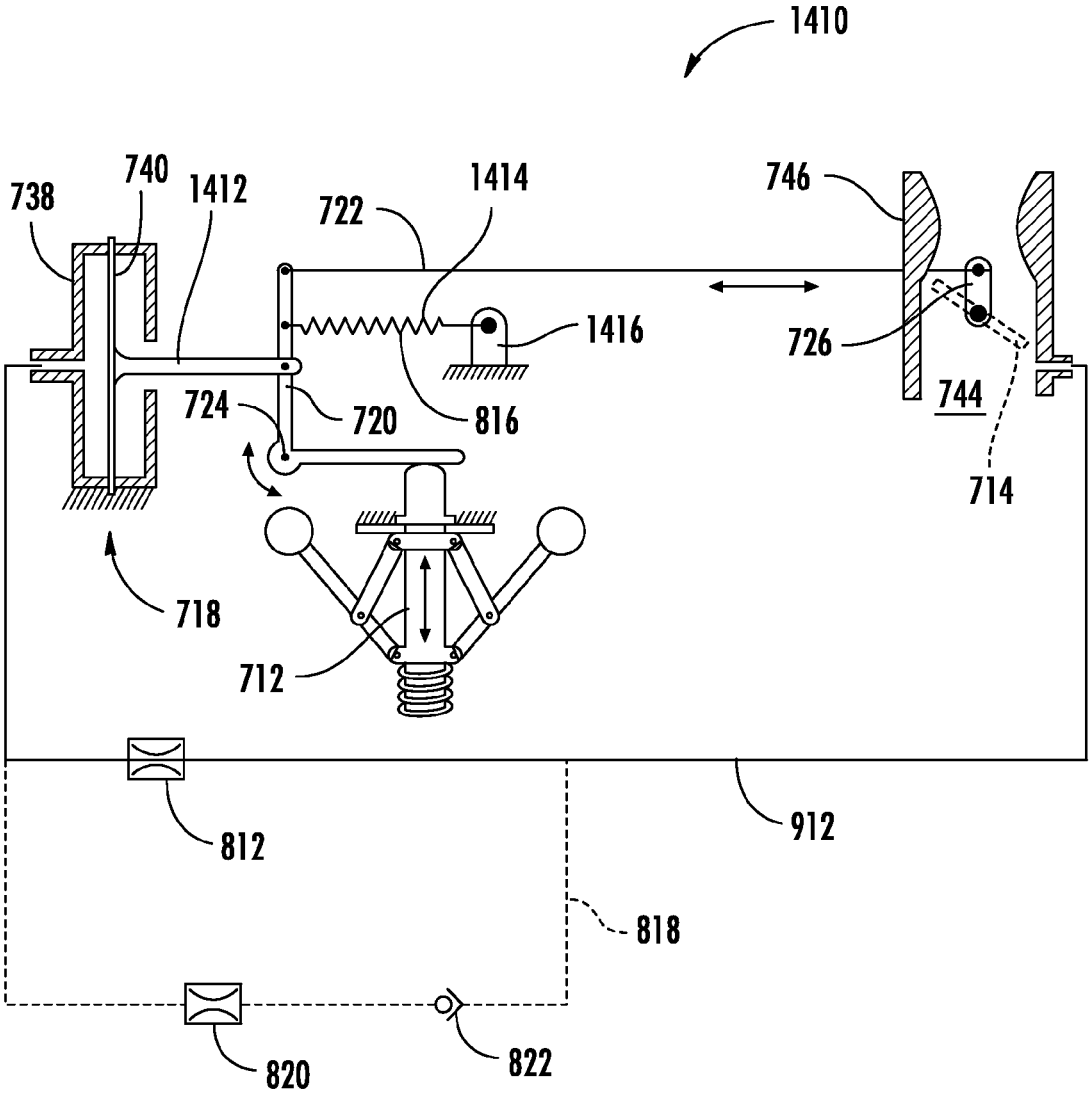
FIG. 13 is a schematic diagram of a control system according to yet another exemplary embodiment of the invention.

Referring to FIG. 12, a speed control system 1310 includes the governor 712 and associated components coupled to the throttle lever 726. Additionally, a conduit 1312 is connects the air of the intake manifold to the actuator 718, which is coupled directly to the throttle lever 726 by the rod 1314. Referring now to FIG. 13, a system 1410 includes the actuator 718 coupled directly to the governor arm 720 by a rod 1412. A spring 1414 anchored at a tang 1416 biases the governor arm 720. In still other embodiments, components of the systems 710, 810, 910, 1310, 1410 may be otherwise coupled and arranged, where components of one of the systems 710, 810, 910, 1310, 1410 may be added to others of the systems 710, 810, 910, 1310, 1410, double, tripled, removed, etc.

Figure 14:
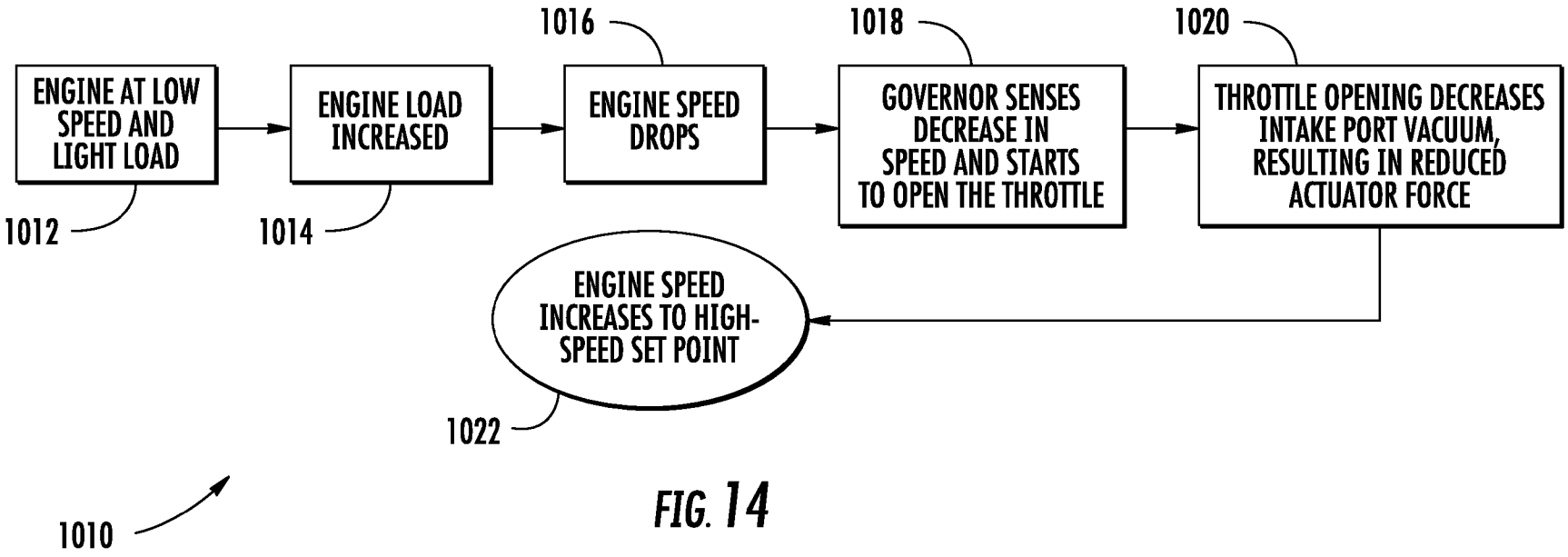
FIG. 14 is a first flow chart of a method of controlling engine speed according to an exemplary embodiment.
Figure 15:
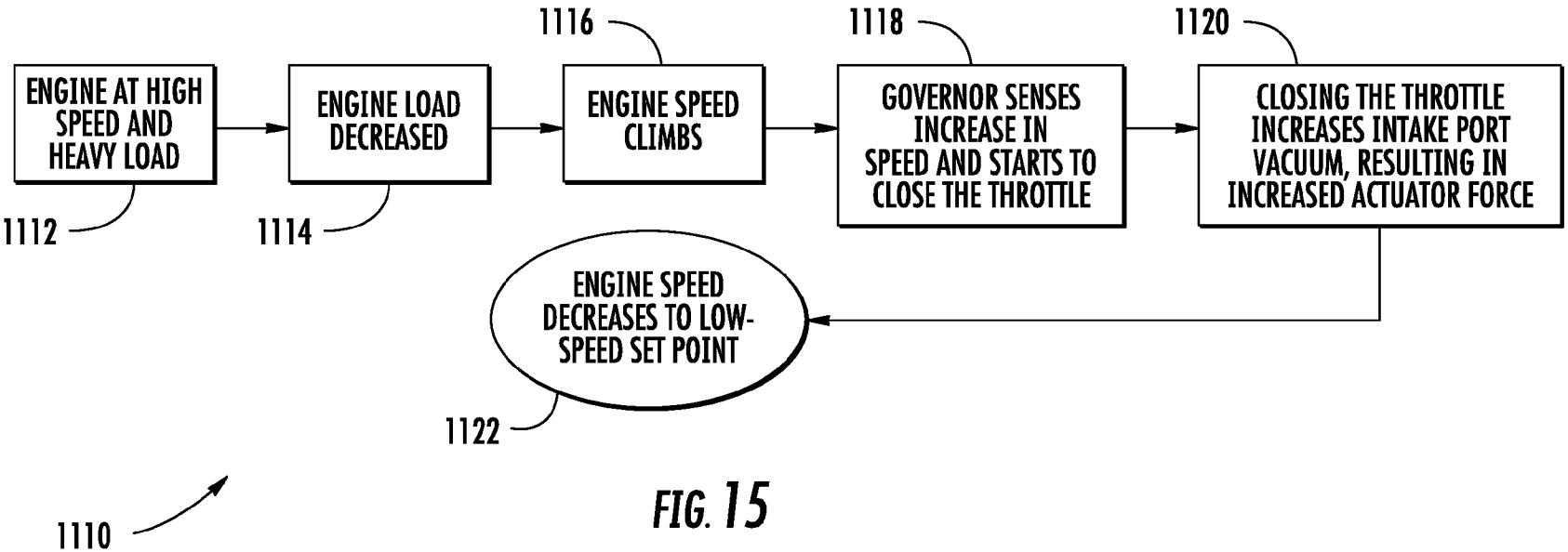
FIG. 15 is a second flow chart of the method of controlling engine speed of FIG. 14.

Referring to FIGS. 14-15 a process of controlling engine speed includes several steps. Referring to FIG. 14, an engine is transitioned from a light load configuration to a heavy load configuration according to process 1010. First, the engine is run at a light load and low speed (step 1012). Next, the load is increased, such as when a work implement is actuated (step 1014). As a result of the increased load, the engine speed decreases (e.g., "droop") (step 1016). A governor coupled to the engine senses the decrease in engine speed and begins opening a throttle of the engine (step 1018). As a result of opening the throttle, the intake manifold (e.g., intake port) vacuum is decreased. Decrease in engine vacuum is sensed by an actuator (e.g., sensor and actuator combination), which reduces force applied to the throttle (step 1020). As such, the engine speed increases to a high-speed set point (step 1022).

The process 1110 of FIG. 15 represents an engine transitioning from a heavy load configuration to a light load configuration. First, the engine is running at a high speed and heavy load (step 1112). As engine load is decreased (step 1114), the engine speed increases (step 1116). The governor senses the increased speed and starts to close the throttle (step 1118). However, closing the throttle increases the intake port vacuum, which increases the force applied to the throttle by the actuator (step 1120). As a result, the engine speed decreases to a low-speed set point (step 1122).

Figure 16:
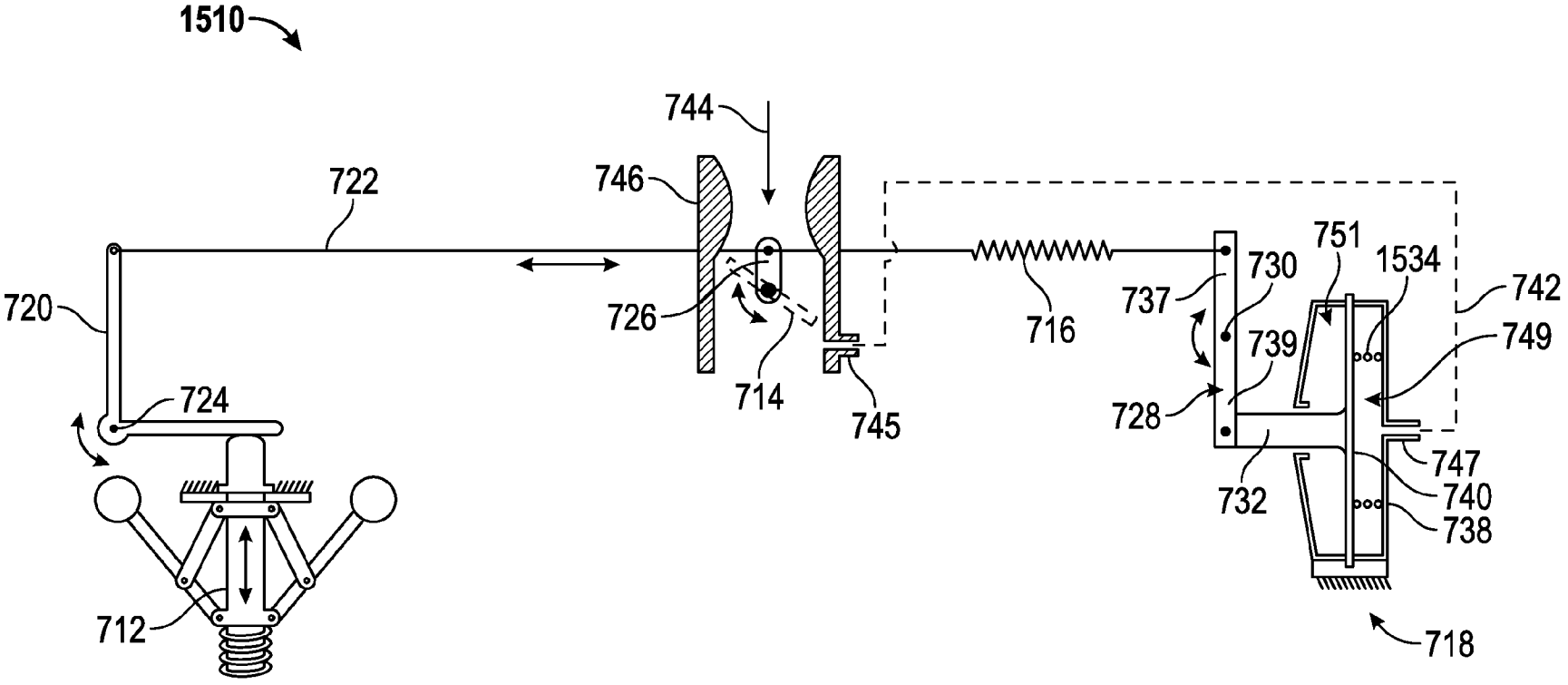
FIG. 16 is a schematic diagram of a control system according to an exemplary embodiment of the invention.
Figure 18:
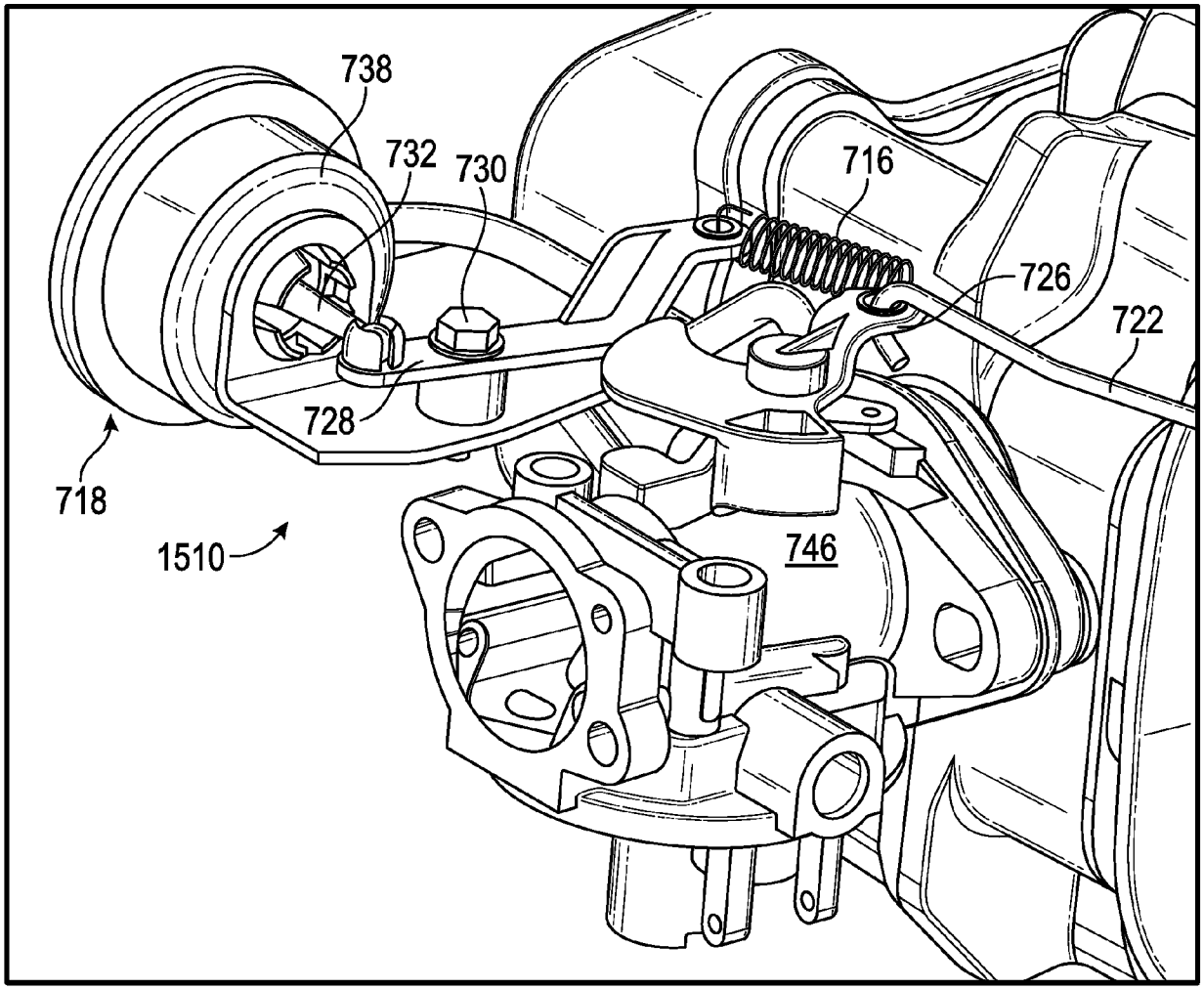
FIG. 18 is a perspective view of a portion of an engine according to the embodiment of FIG. 16.

Referring to FIGS. 16 and 18, control system 1510 is shown in accordance with another exemplary embodiment of the invention. An actuator spring, shown as spring 1534 in FIG. 16, internal to the actuator 718 biases the actuator linkage, shown as rod 732. In the embodiment shown in FIG. 16, spring 1534 is a coil spring, but in other embodiments the spring may have different configurations such as a flat spring, a leaf spring, or other suitable biasing member. The spring 1534 is coupled to the rod 732 and to the actuator housing, shown as housing 738. The housing 738 is considered to be a fixed attachment point because the housing is not configured to move during normal operation of the engine. The spring 1534 biases the rod 732 to increase the tension on the governor spring 716 (i.e., cause pivoting member 728 to rotate clockwise as shown in FIG. 16). The engine vacuum pressure on the pressure-sensitive member (shown as diaphragm 740) opposes the bias of the spring 1534. When the engine vacuum pressure transitions from high to low (e.g., from a low load to a heavy load on the engine), the force exerted by the spring 1534 on the rod 732 dominates the force exerted by the diaphragm 740 on the rod 732 due to the engine vacuum pressure, thereby increasing the tension on the governor spring 716 and causing the throttle plate 714 to open more quickly than in a control system without the vacuum actuator 718. When the engine vacuum pressure transitions from low to high (e.g., from a high load to a low load on the engine), the force exerted by the spring 1534 on the rod 732 is dominated by the force exerted by the diaphragm 740 on the rod 732 due to the engine vacuum pressure, thereby decreasing the tension on the governor spring 716 and causing the throttle plate 714 to close more quickly than in a control system without the vacuum actuator 718.

The rod 732 is shown in FIG. 16 as directly coupled to the pivoting member 728 (i.e., there are no springs or other variable-length components between the rod 732 and the pivoting member 728). This prevents the pivoting member 728 from moving separately from the rod 732. The vacuum actuator 718 can also be considered to be directly coupled to the governor spring 716 because there are no springs or other variable-length components between the rod 732 of the vacuum actuator 718 and the governor spring 716. By directly coupling the rod 732 and the pivoting member 728, the engine control system 1510 reacts more quickly to changes in engine vacuum pressure because there is no slack, slop, or tension, that needs to be taken up between the rod 732 and the pivoting member 728 in order for the movement of the rod 732 to cause movement of the pivoting member 728, resulting in better transient response than an engine control system that includes a spring or other variable-length component between a vacuum actuator and a governor spring. Another advantage of directly coupling the rod 732 to the pivoting member 728 is that the combination of the vacuum actuator 718 and the pivoting member 728 can be added to an existing engine design without having to recalibrate or change the governor spring 716. When a spring or other variable-length component is included between the pivoting member 728 and the rod 732, this spring and the governor spring 716 have to be calibrated, adjusted, and/or changed so that the two springs will work together to achieve the desired engine control strategy. Additionally, control system 1510 can include a restrictor (e.g., pneumatic damper, pneumatic valve) positioned along the conduit 742 similar to restrictor 812 described above.

Figure 17:
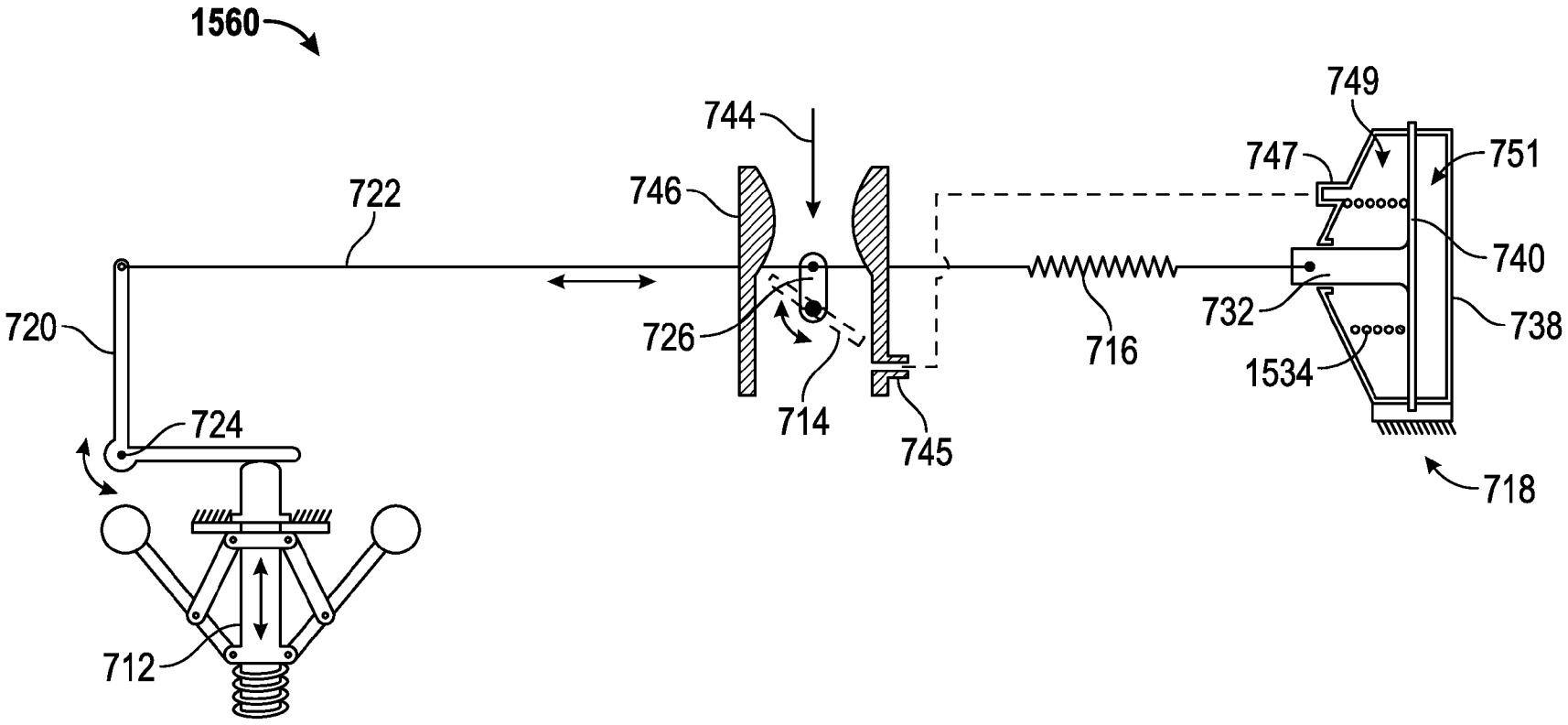
FIG. 17 is a schematic diagram of a control system according to an exemplary embodiment of the invention.

Referring to FIG. 17, a control system 1560 is shown in accordance with another exemplary embodiment of the invention. The vacuum actuator 718 includes the intake port 747 on the same side as the rod 732, as opposed to the vacuum actuator 718 shown in FIG. 16, which has the intake port 747 and the rod 732 on opposite sides. By providing the engine vacuum pressure to the same side of the vacuum actuator 718 as the rod 732, pivoting member 728 as shown in FIG. 16 can be omitted from control system 1560 because there is no longer the need to translate the movement of the diaphragm 740 to achieve the desired change in tension on the governor spring 716. A seal (e.g., a rubber boot, a bellows, a gasket, etc.) may be included where the rod 732 passes through the housing of the actuator to prevent air from leaking into or out of the vacuum actuator 718 at this location. Additionally, control system 1560 can include a restrictor (e.g., pneumatic damper, pneumatic valve) positioned along the conduit 742 similar to restrictor 812 described above.

Figure 19:
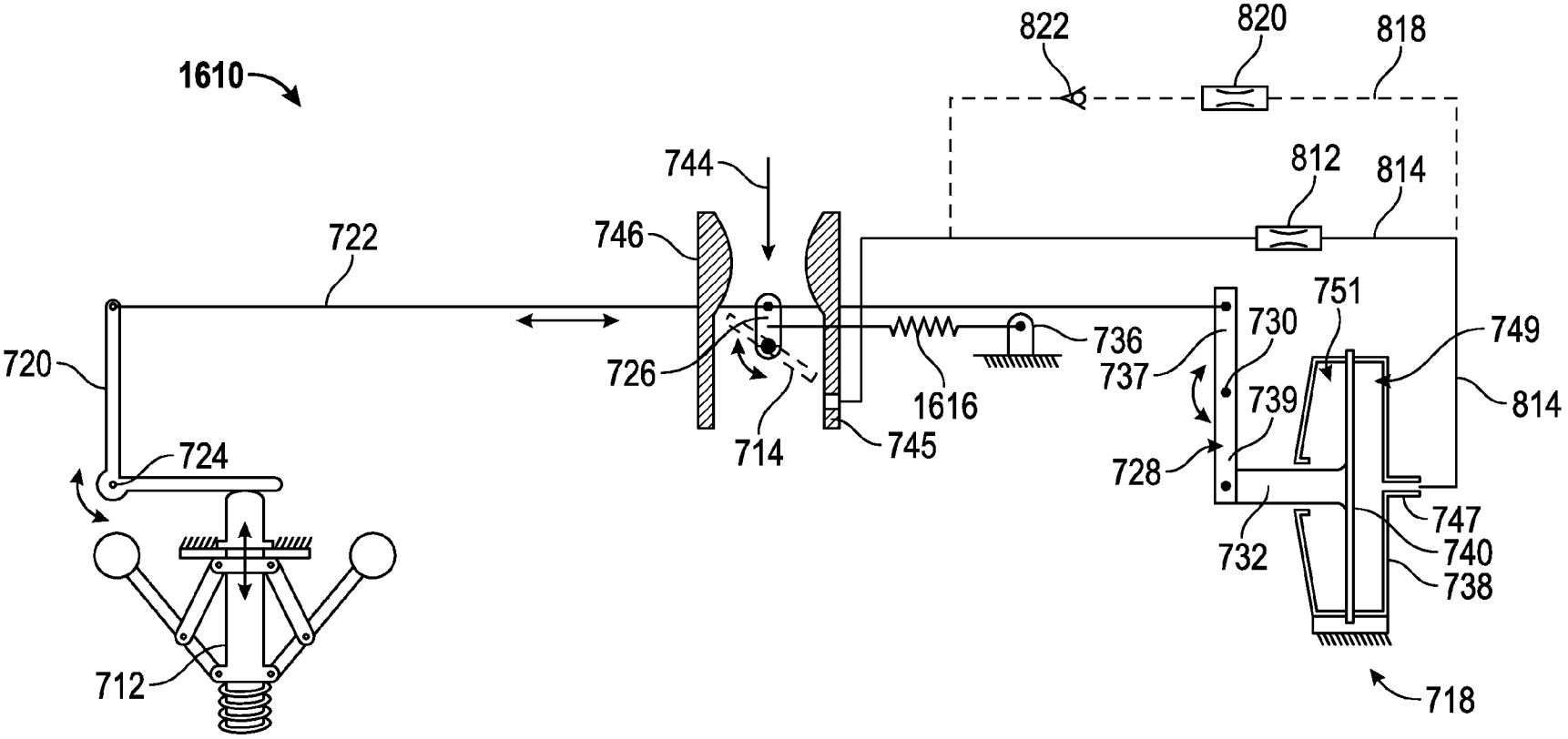
FIG. 19 is a schematic diagram of a control system according to an exemplary embodiment of the invention.

Referring to FIG. 19, a control system 1610 is shown in accordance with another exemplary embodiment of the invention. A governor spring 1616 is connected between the throttle lever 726 and a fixed tang or bracket 736 located elsewhere on the engine. The governor spring 1616 may replace the governor spring 816 of control system 810. Depending on the location, size, and shape of other components of an engine, either of control systems 810 and 1610 may be preferred due to ease of assembly and/or positioning relative to the other components of the engine. Additionally, control system 1610 can include a restrictor (e.g., pneumatic damper, pneumatic valve) positioned along the conduit 742 similar to restrictor 812 described above.

Figure 20:
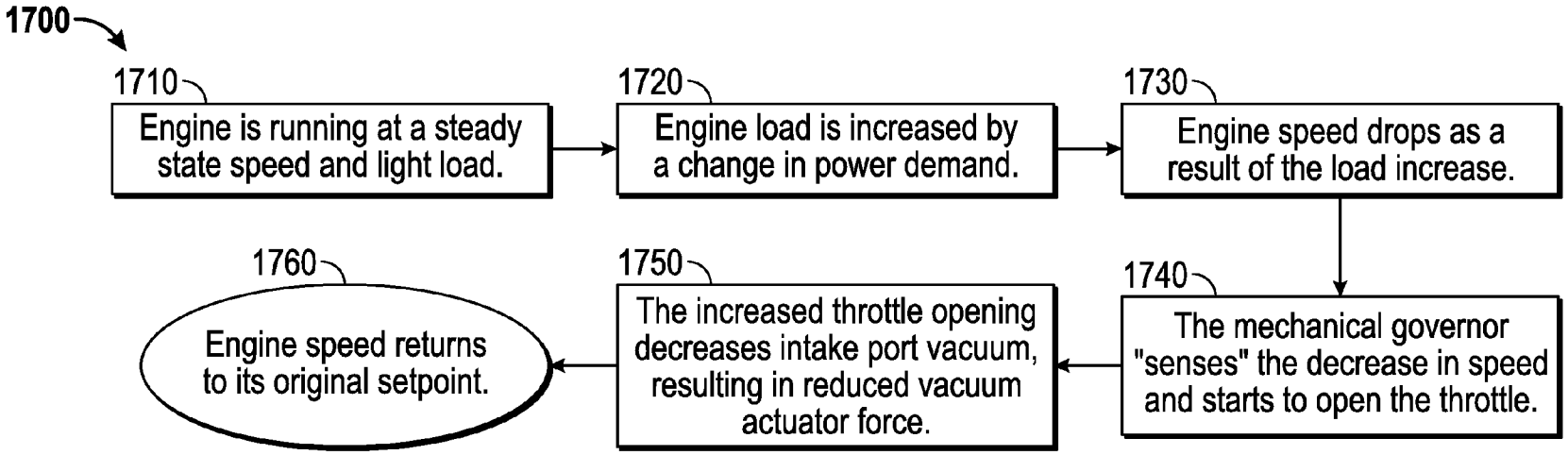
FIG. 20 is a first flow chart of a method of controlling engine speed according to an exemplary embodiment.
Figure 21:
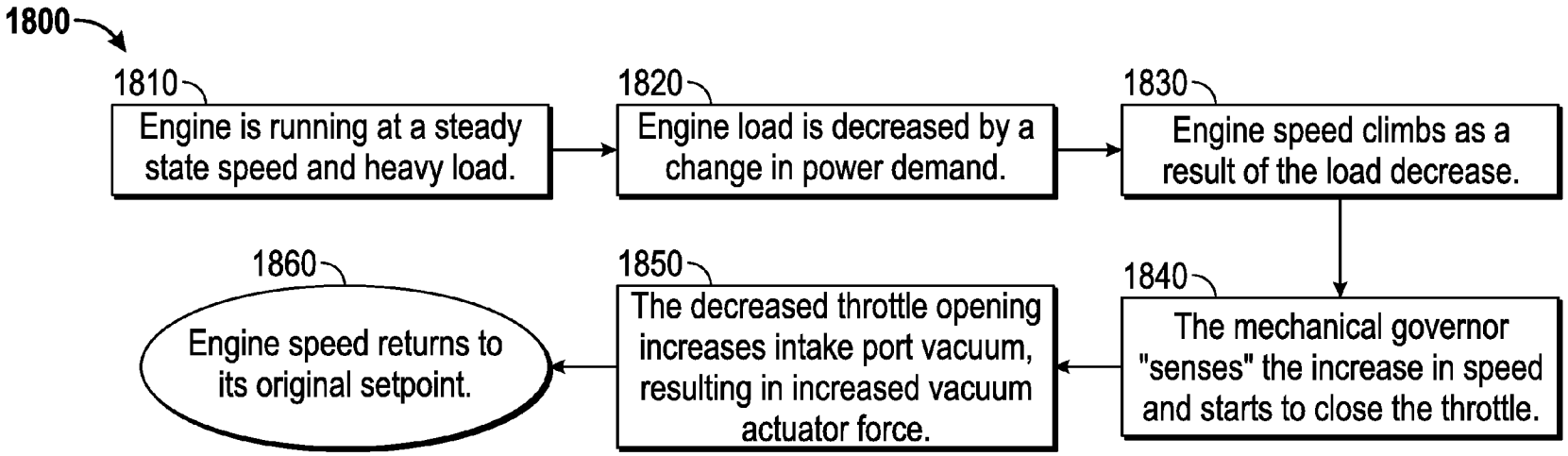
FIG. 21 is a second flow chart of the method of controlling engine speed of FIG. 21.

Referring to FIGS. 20-21, a process of controlling engine speed according to a "zero droop" control strategy is illustrated. FIG. 20 illustrates a process 1700 of an engine transitioning from a light load to a heavy load under the zero droop control strategy. FIG. 21 illustrates a process 1800 of an engine transitioning from a heavy load to a light load under the zero droop control strategy. Any of control systems 710, 810, 910, 1310, 1410, 1510, 1560, and 1610 is suitable for use with the zero droop control strategy described herein.

Under the zero droop control strategy, the control system 710, 810, 910, 1310, 1410, 1510, 1560, or 1610 is configured to maintain a substantially constant engine speed (e.g., plus or minus fifty rpm relative to the engine speed setpoint or plus or minus 1.5% of the engine speed setpoint). For example, the engine speed setpoint for a lawn mower can be anywhere between 2900 rpm and 3800 rpm. In other words, the zero droop control strategy minimizes the droop in engine speed experienced by the engine when transitioning from a light load to a heavy load. Zero droop control is appropriate when an engine will be loaded with a high inertia work element, for example, a lawn mower blade (e.g., a vertical-shaft engine on a walk-behind lawn mower with two blades). For example, when a lawn mower blade is engaged (i.e., coupled to the engine for rotation driven by the engine), the engine experiences a transition from a light load to a heavy load and has to overcome the high inertia of the stationary lawn mower blade. Another example is when a lawn mower is moved from cutting relatively low or thin grass to cutting relatively high or thick grass, the increase in grass height and/or thickness results in an increased load on the engine. An improperly controlled engine may stall because the throttle does not react quickly enough to supply the engine now under heavy load with sufficient fuel and air to keep the engine above the stall speed. An engine with a control system configured with the zero droop control strategy avoids this stalling problem by maintaining a substantially constant engine speed.

Referring to FIG. 20, an engine including a control system configured for zero droop control is running at steady state at an engine speed setpoint under a light load (step 1710). The engine load is increased by a change in power demand (step 1720). An example of increasing the engine load is when the blade of a lawn mower is engaged (i.e., coupled to the engine so that the blade rotates). The engine speed begins to drop as a result of the increased load (step 1730). The engine's governor detects or senses the reduction in engine speed and, in response, opens the throttle (i.e., increases the size of the throttle opening) in an attempt to return the engine to the engine speed setpoint (step 1740). By opening the throttle, the vacuum on the intake port detected or sensed by the vacuum actuator decreases, which reduces the vacuum actuator force applied to the throttle (step 1750). The vacuum actuator force opposes the throttle opening force applied by the governor, so reducing the vacuum actuator force causes the throttle to open wider and faster, thereby compensating for the engine speed droop. This compensation results in the engine returning to the engine speed setpoint (step 1760). Process 1700 is intended to result in a substantially constant engine speed (e.g., plus or minus 50 rpm relative to the engine speed setpoint) when the engine transitions from light load to heavy load.

Referring to FIG. 21, an engine including a control system configured for zero droop control is running at a steady state at steady state at an engine speed setpoint under a heavy load (step 1810). The engine load is decreased by a change in power demand (step 1820). An example of decreasing the engine load is when the blade of a lawn mower is disengaged (i.e., decoupled from the engine). The engine speed begins to increase as a result of the decreased load (step 1830). The engine's governor detects or senses the increase in engine speed and, in response, attempts to close the throttle (i.e., decreases the size of the throttle opening) to return the engine to the engine speed setpoint (step 1840). By closing the throttle, the vacuum on the intake port detected or sensed by the vacuum actuator increases, which increases the vacuum actuator force applied to the throttle (step 1850). The vacuum actuator force opposes the throttle opening force applied by the governor, so increasing the vacuum actuator force causes the throttle to close narrower and faster, thereby reducing the size of the engine speed spike or increase as compared to that experienced by an engine without the vacuum actuator. This results in the engine returning to the engine speed setpoint (step 1860). Process 1800 is intended to result in a substantially constant engine speed (e.g., plus or minus fifty rpm relative to the engine speed setpoint) when the engine transitions from heavy load to light load.

The control systems 710, 810, 910, 1310, 1410, 1510, 1560, and 1610 can be configured with the idle down or negative droop processes 1010 and 1110 or with the zero droop processes 1700 and 1800. The relative strength of the biases on the throttle lever 710 associated with the governor 712 and with the vacuum actuator 718 determine whether the control system 710, 810, 910, 1310, 1410, 1510, 1560, or 1610 is configured with a negative droop process or a zero droop process. For example, changing the length of a moment arm (e.g., the distance from fulcrum 730 to governor linkage 722 or the distance from the fulcrum 730 to the rod 732 of the vacuum actuator 718) on the pivoting member 728 changes the relative biases applied to the throttle by the governor 712 and by the vacuum actuator 718.

Figure 22:
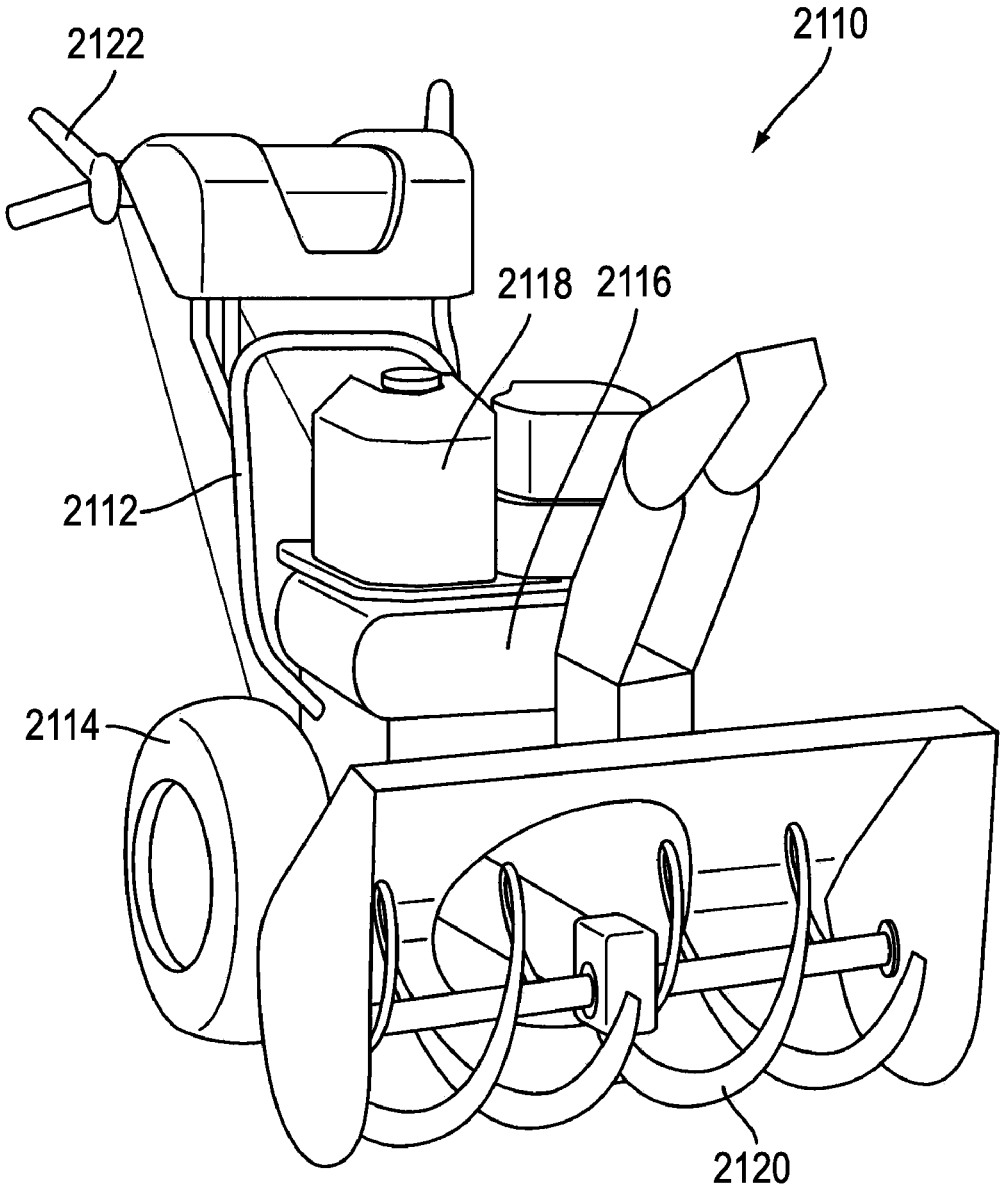
FIG. 22 is a perspective view of a snow thrower according to an exemplary embodiment of the invention.

Referring to FIG. 22, outdoor power equipment in the form of a snow thrower 2110 includes a frame 2112, wheels 2114 coupled to the frame 2112, an engine 2116, and fuel tank 2118. The snow thrower 2110 further includes a rotating tool in the form of an auger 2120 that is configured to be driven by the engine 2116. A control interface in the form of one or more of a throttle lever 2122, on/off switch, and drive settings, or other features is coupled to the frame 2112. While FIG. 22 shows the snow thrower 2110, in other embodiments, outdoor power equipment may be in the form of a broad range of equipment, such as a walk-behind or driving lawnmower, a rotary tiller, a pressure washer, a tractor, or other equipment using an engine.

Figure 23:
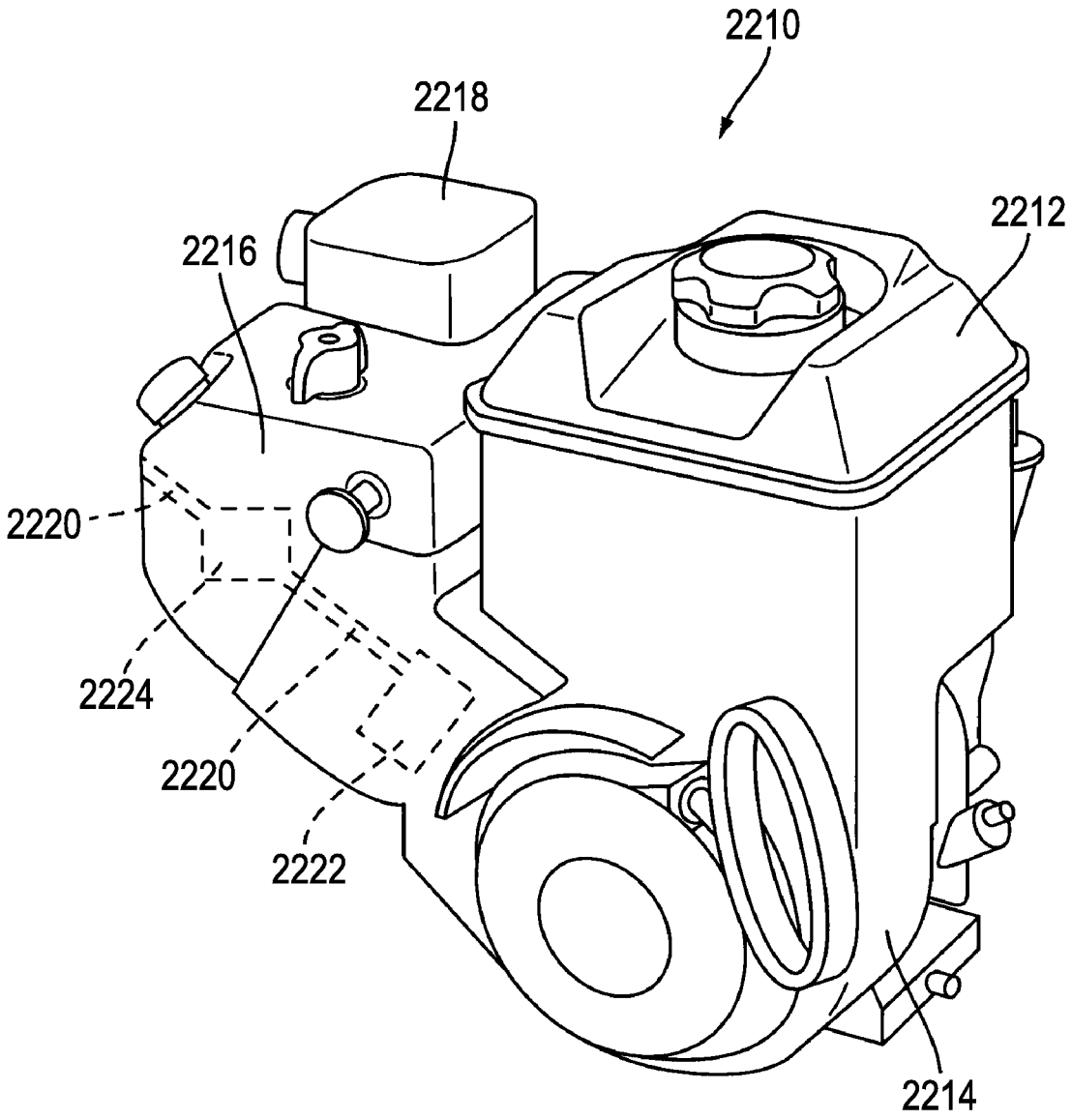
FIG. 23 is a perspective view of an engine according to an exemplary embodiment of the invention.

Referring to FIG. 23, an engine in the form of a small, single-cylinder, four-stroke cycle, internal combustion engine 2210 includes a fuel tank 2212, an engine block 2214, an air intake 2216, and an exhaust 2218. Interior to the engine 2210, the engine 2210 includes a passageway 2220 configured to channel air from the air intake 2216 to a combustion chamber 2222. Along the passageway 2220, fuel is mixed with the air in a carburetor 2224 or other fuel injection device. Combustion in the combustion chamber 2222 converts chemical energy to mechanical energy (e.g., rotational motion; torque) via a piston, connecting rod, and crankshaft, which may then be coupled to one or more rotating tools (e.g., blade, alternator, auger, impeller, tines, drivetrain) of outdoor power equipment.

Figure 24:
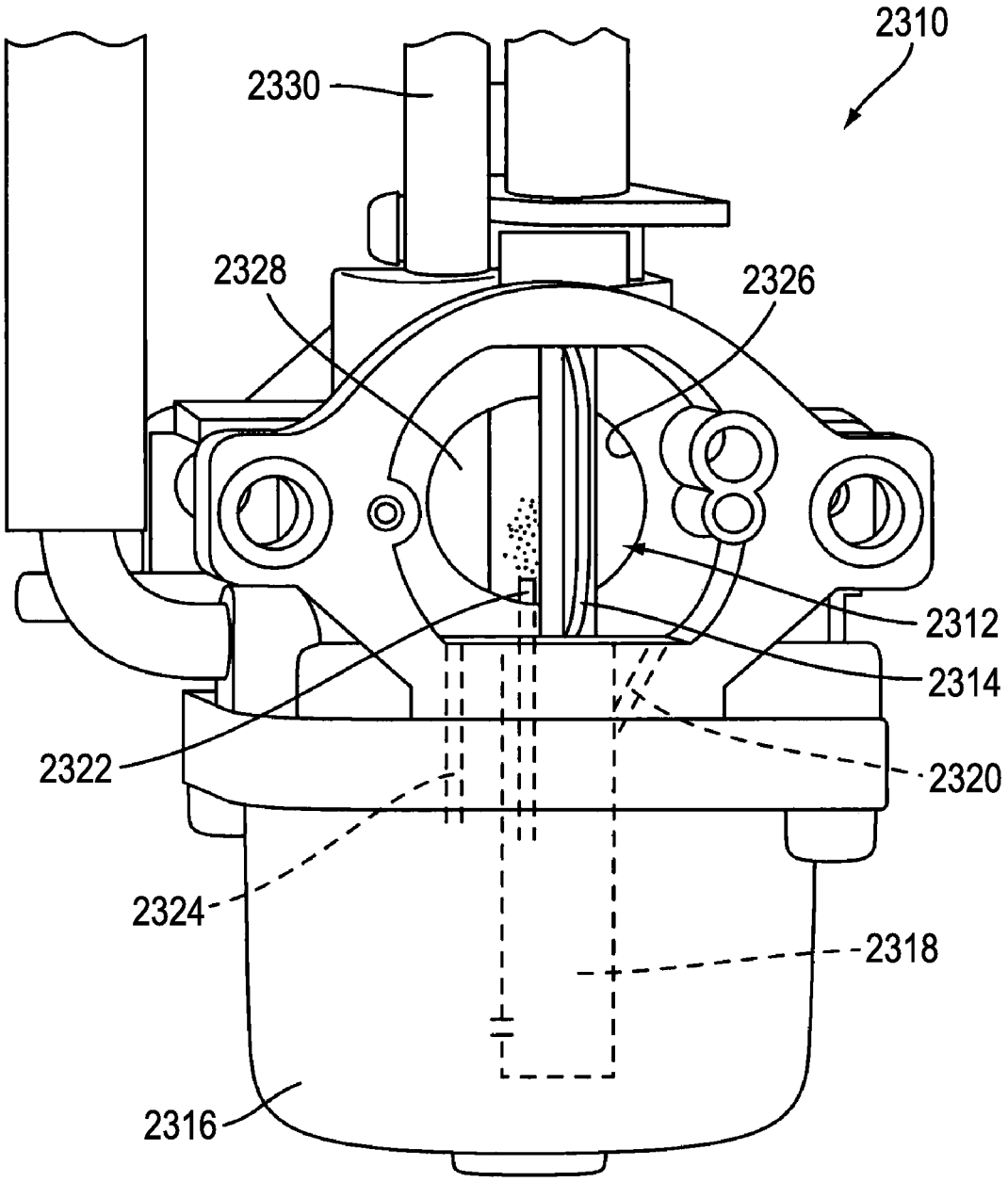
FIG. 24 is a perspective view of a carburetor in a first configuration according to an exemplary embodiment of the invention.
Figure 25:
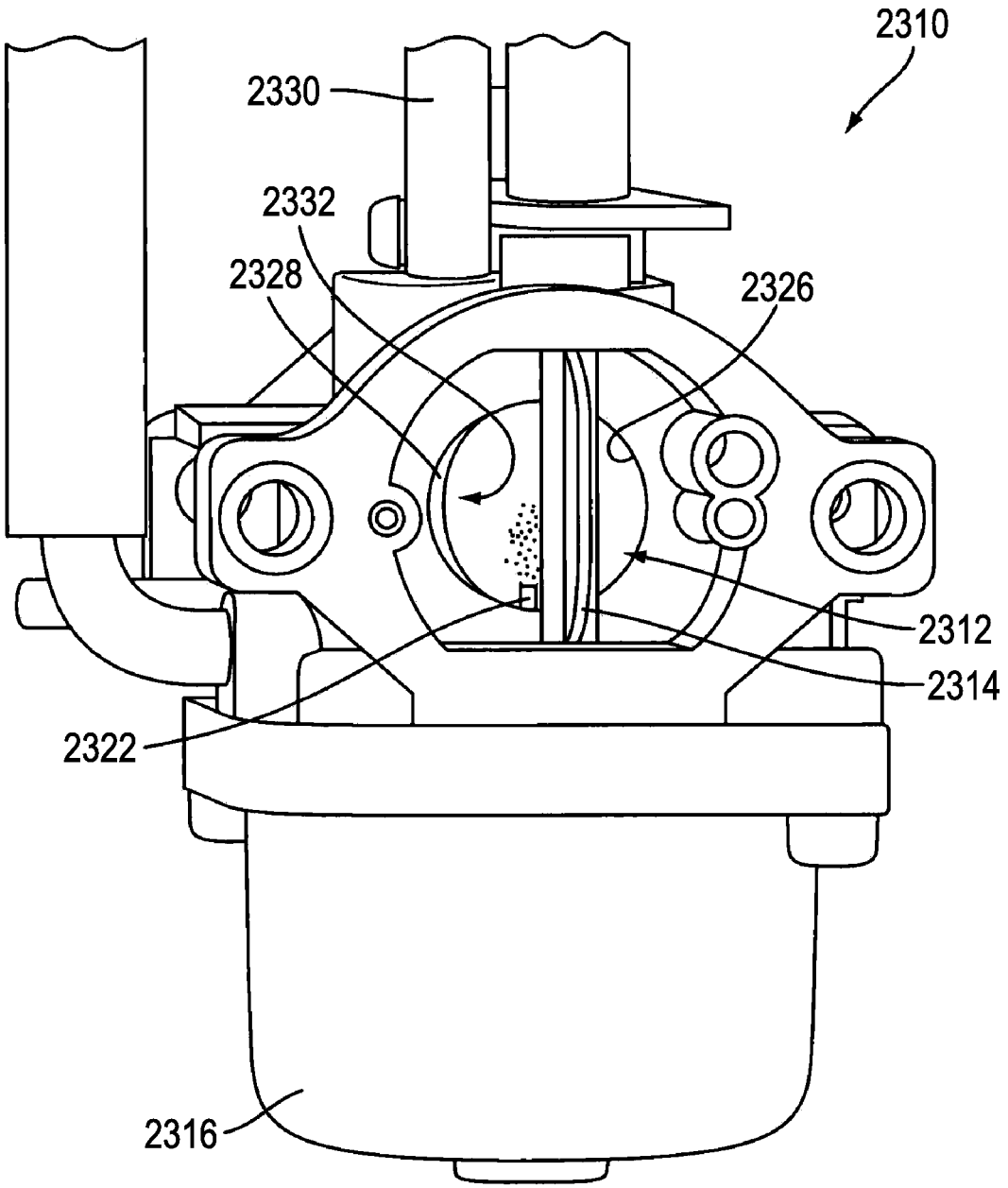
FIG. 25 is a perspective view of the carburetor of FIG. 3 in a second configuration.

Referring now to FIGS. 24-25, a carburetor 2310 for an engine (see, e.g., engine 2210 as shown in FIG. 23) includes a throat 2312 (e.g., conduit, passage, flow path) and, in some embodiments, at least one plate 2314 (e.g., throttle plate, choke plate, both throttle and choke plates) configured to function as a butterfly valve to control the flow of air, or a mixture of fuel and air, through the carburetor 2310. In FIGS. 24-25 the plate 2314 is in an open configuration (e.g., wide-open throttle). According to an exemplary embodiment, the throat 2312 of the carburetor 2310 is positioned along a passageway extending from an air intake of the engine to a combustion chamber of the engine (see, e.g., passageway 2220 as shown in FIG. 23).

The carburetor 2310 is coupled to (e.g., in fluid communication with) a fuel tank (see, e.g., fuel tank 2118 as shown in FIG. 22) by way of a fuel line or other conduit. The fuel tank may be mounted to the engine, integrated with the engine, or positioned on a frame of outdoor power equipment apart from the engine. In some embodiments the carburetor 2310 includes a bowl 2316 (e.g., container) that receives fuel from the fuel line. In some such embodiments, a float coupled to a valve is used to regulate the flow of fuel from the fuel line into the bowl 2316. From the bowl 2316, the fuel is delivered to a well 2318 of the carburetor 2310 (e.g., emulsion tube well), which is also coupled to a vent 2320 and a nozzle 2322. In some embodiments, air flows into the well 2318 through the vent 2320 and mixes with the fuel. Another vent 2324 may be coupled to the bowl 2316.

According to an exemplary embodiment, the carburetor 2310 includes a constricted section 2326 (e.g., narrower segment, venturi) integrated with the throat 2312 that is bordered by wider portions of the passageway. The nozzle 2322 of the carburetor 2310 is directed into the passageway proximate to the constricted section 2326, such as along the portion of the passageway closely following the most constricted portion of the constricted section 2326. As air flows along the passageway through the carburetor 2310, the velocity of the air increases through the constricted section 2326. The increase in velocity corresponds to a decrease in pressure, which acts upon the nozzle 2322, drawing fuel through the nozzle 2322 and into the flow of air through the passageway.

According to an exemplary embodiment, the carburetor 2310 further includes a surface 2328 that at least partially defines the constricted section 2326. The surface 2328 is configured to be adjusted to change the area of the passageway through the constricted section 2326. In some embodiments, the surface 2328 is at least a portion of a contour on a shaft 2330. As the shaft 2330 is moved relative to the passageway, the orientation or position of the contour is changed relative to the passageway, which changes the shape of the surface 2328 and the corresponding area of the constricted section 2326 of the passageway.

In some embodiments, the surface 2328 includes a section of the shaft 2330. In such embodiments, the shaft 2330 is substantially cylindrical, but includes a recess 2332 (e.g., cut, open portion) on a side of the shaft 2330 (FIG. 25). The surface 2328 of the shaft 2330 that at least partially forms the constricted section 2326 of the passageway changes as the shaft 2330 is moved (e.g., rotated, translated) relative to the passageway. In a first configuration (e.g., normal mode), the recess 2332 is not exposed to the passageway (FIG. 24), which corresponds to greater air flow restriction of the constricted section 2326. In a second configuration (e.g., power boost, boost mode), the recess 2332 is exposed to the passageway (FIG. 25), which corresponds to lesser air flow restriction of the constricted section 2326. In contemplated embodiments, the surface that adjusts the area of the constricted section is on the end of a shaft, which is translated relative to the passageway to change the area of the constricted section.

In the second configuration, the carburetor 2310 allows for a greater volume of air to flow through the passageway by reducing the restriction provided by the constricted section 2326. However, the velocity of air through the constricted section 2326 may correspondingly be reduced, decreasing the vacuum experienced at the end of the nozzle 2322 that is open to the passageway. In some embodiments, a vent connecting the well 2318 to outside air is at least partially restricted when the carburetor 2310 is in the second configuration, which is intended to increase the amount of fuel pulled through the nozzle 2322, by decreasing the flow of outside air into the well 2318 in response to suction from the nozzle 2322. Instead, a greater amount of fuel is pulled into the well 2318 from the bowl 2316 in response to suction from the nozzle 2322. In addition, less air is available to mix with the fuel that exits the nozzle 2322. In contemplated embodiment, a variable restrictor is integrated with the nozzle, the bowl, the fuel line, or another part of the engine to adjust the flow rate of fuel or air to compensate for changes in air pressure through the constricted section 2326 of the passageway.

Figure 26:
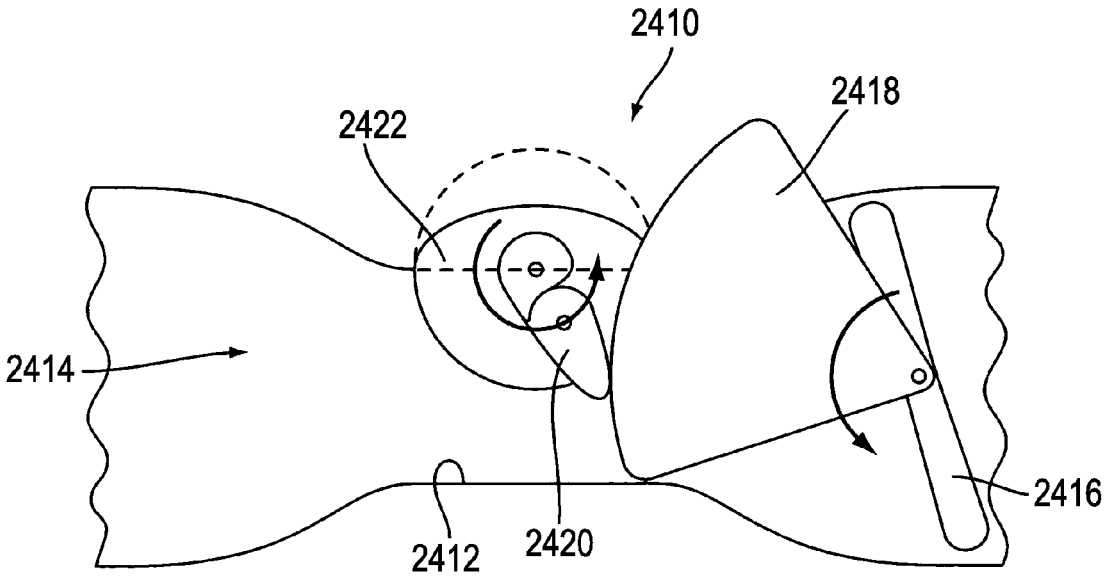
FIG. 26 is a schematic view of a locking system for a carburetor in a first configuration according to an exemplary embodiment of the invention.
Figure 27:
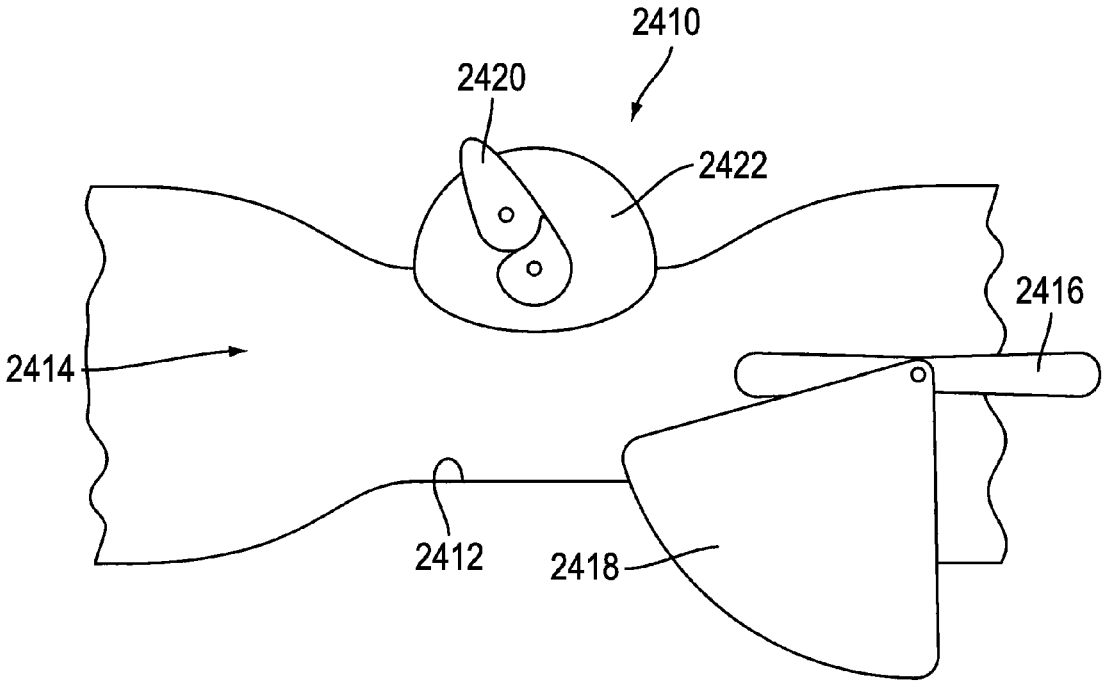
FIG. 27 is a schematic view of the locking system of FIG. 5 in a second configuration.

Referring to FIGS. 26-27 a locking system 2410 (e.g., interlock, blocking system) is configured to limit the ability to change the area of a constricted section 2412 of a passageway 2414 when a throttle plate 2416 of the passageway 2414 is not in the wide-open throttle position. For example, the area of the constricted section 2412 may be locked and thereby not able to be manually adjusted when the throttle plate 2416 of the passageway 2414 is not in the wide-open throttle position. The locking system 2410 may be mechanically, electrically, pneumatically, or otherwise controlled, and may include interfering gears, locking solenoids, releasable hooks, sliding latches, or other components for interlocking parts or limiting movement.

According to an exemplary embodiment, the locking system 2410 is mechanically-controlled via interaction of cams. In FIG. 26, a first cam 2418 coupled to the throttle plate 2416 interferes with a second cam 2420 coupled to a vertical shaft 2422 extending through a portion of the constricted section 2412 of the passageway 2414. When the throttle plate 2416 is rotated to an open configuration (e.g., wide-open throttle) as shown in FIG. 27, the first cam 2418 no longer interferes with the second cam 2420. An operator or controller of the shaft 2422 is able to rotate the shaft 2422 counterclockwise, to change the portion of the shaft 2422 that is exposed to the passageway 2414, and thereby change the area of the constricted section 2412. In some embodiments, the second cam 2420 includes two parts that allow for free rotation in one direction, while interlocking to hold the shape of the second cam 2420 when rotated in the opposite direction. For example, the two parts of the second cam 2420 allow the second cam 2420 to freely rotate clockwise to return the second cam 2420 to the position of FIG. 26 from the position of FIG. 27, even if the first cam 2418 is already in the position of FIG. 26.

Figure 28:
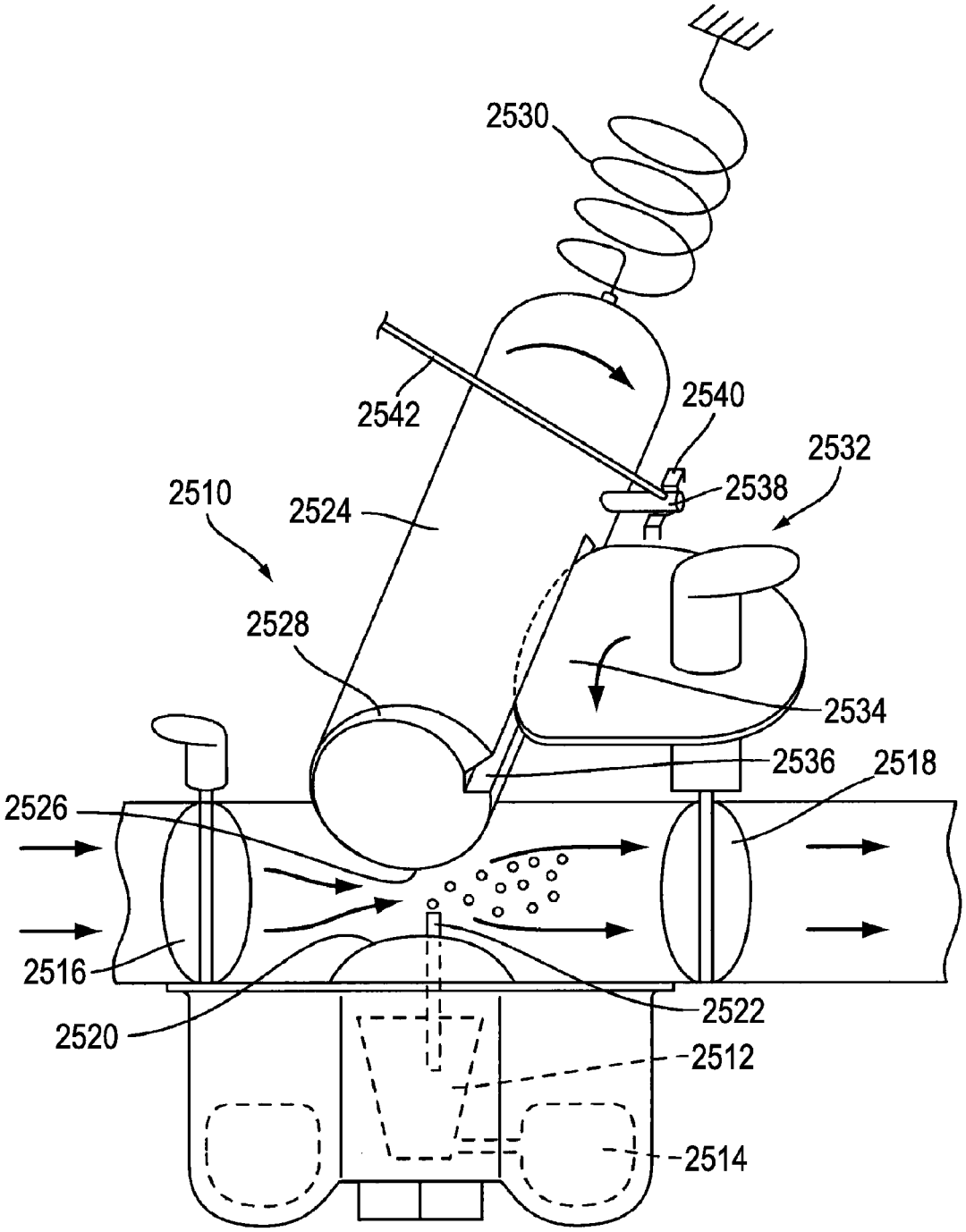
FIG. 28 is a schematic view of a carburetor according to another exemplary embodiment of the invention.

Referring to FIG. 28, a carburetor 2510 for an internal combustion engine includes a flow path for air passing between an air intake and a combustion chamber of the engine. The carburetor includes a choke plate 2516, a throttle plate 2518, and a constricted section 2520. A nozzle 2522 is open to the flow path proximate to the constricted section 2520 and is configured to supply fuel to air passing through the carburetor 2510. According to an exemplary embodiment, the fuel is provided to the nozzle 2522 from a well 2512 in the carburetor 2510, which is in communication with a bowl 2514 of the carburetor 2510.

According to an exemplary embodiment, the carburetor 2510 includes a shaft 2524 that forms a surface 2526 of the constricted section 2520 of the flow path. As shown in FIG. 28, the shaft 2524 is oriented horizontally with respect to the flow path and includes a contour 2528 associated with the constricted section 2520. According to an exemplary embodiment, the contour 2528 is a segment of a spiral, where the radius of the contour 2528 continuously decreases from one angular position to the other about the shaft 2524 (i.e., from one end of the contour 2528 to the other about the shaft 2524). As the shaft 2524 is rotated relative to the flow path, the amount of the surface 2526 protruding into the constricted section 2520 of the flow path decreases, which widens the constricted section 2520. Use of a spiral segment or other continuously variable geometry allows for a continuously variable area of the constricted section 2520, which may facilitate optimization of the flow path for a given load on the engine, reducing carbon emissions, improving engine performance (e.g., create more power, improved start-ability, and improved "load pickup" or response to changes in load), and increasing fuel efficiency.

According to an exemplary embodiment, the shaft 2524 is biased to a first orientation, which corresponds to a narrower area of the constricted section 2520. In some embodiments, the shaft is biased by a torsion spring 2530 coupled to the shaft 2524. In other embodiments, a coil spring or other elastic member is coupled to a side or end of the shaft 2524 to bias the shaft 2524 in the first orientation. In still other embodiments, the end of the shaft 2524 includes a moment arm with a biasing spring or other elastic member, or weight. Bushing, bearings, end pins, and other constraints may be used to limit or facilitate rotation of the shaft.

In some embodiments, the carburetor includes a locking system 2532. According to an exemplary embodiment, the locking system 2532 includes a cam 2534 and a slot 2536. The cam 2534 is coupled to the throttle plate 2518 and the slot 2536 (e.g., ledge, lip, flange) is integrated with the shaft 2524. If the throttle plate 2518 is at least partially closed, the cam 2534 is positioned in the slot 2536, interlocking the cam 2534 and slot 2536 to limit the ability to rotate the shaft 2524. If the throttle plate 2518 is moved to the wide-open throttle position, then the cam 2534 is positioned outside of the slot 2536, and the shaft 2524 is free to rotate. A peg 2538 or other surface in a seat 2540 or other constraint may prevent the shaft 2524 from rotating beyond set limits. An operator or controller can rotate the shaft 2524 counterclockwise via a linkage 2542.

In contemplated embodiments, a carburetor includes a plate having a curved surface that translates relative to the constricted section of the carburetor, or a disk having a variable shape on the periphery of the disk. As different portions of the surface interface with the flow path through the carburetor, the area of the constricted section changes. In still other contemplated embodiments, a belt is used to expand or contract a flexible or moveable surface that forms the constricted section of the carburetor. The area of the constricted section is inversely related to tension in the belt. In other contemplated embodiments, two or more shafts are used in combination to change the area of a constricted section of the flow path. The shafts may be mechanically coupled to one another.

Figure 29:
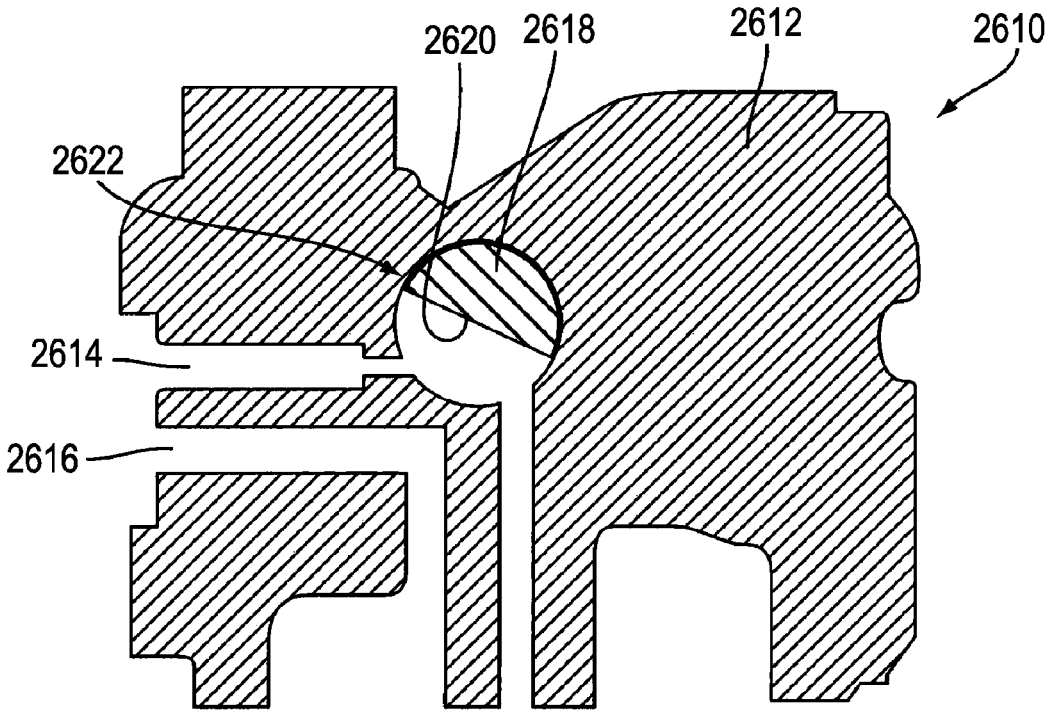
FIG. 29 is a sectional view of vent passages of a carburetor in a first configuration according to an exemplary embodiment of the invention.
Figure 30:
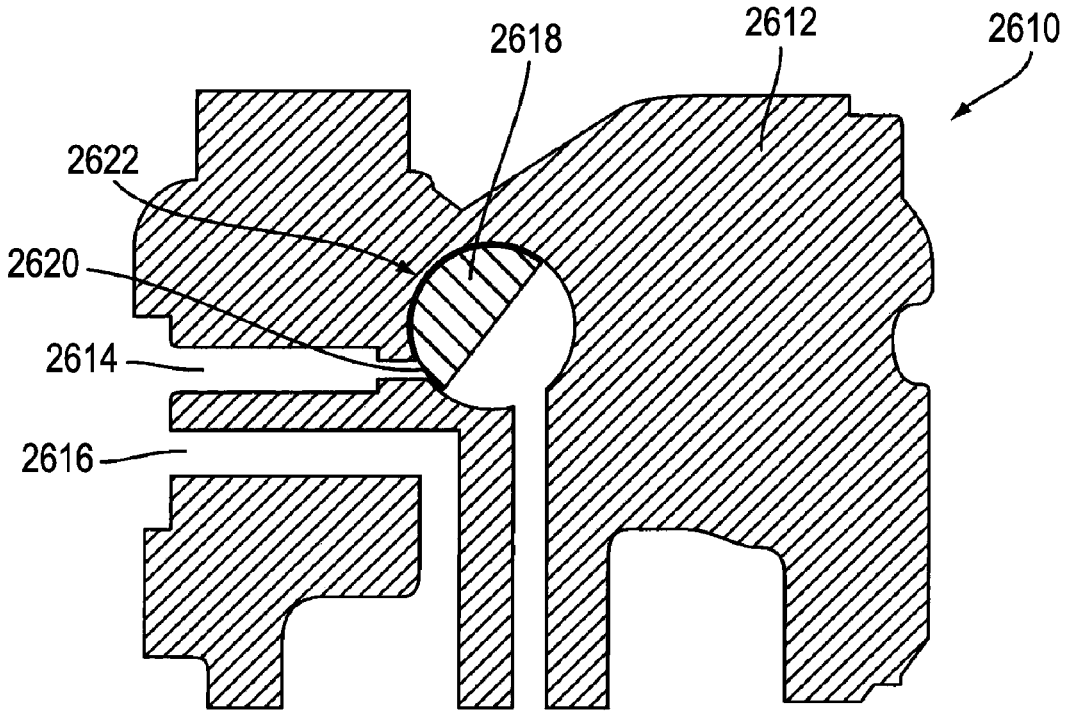
FIG. 30 is a sectional view of the vent passages of FIG. 8 in a second configuration.

Referring now to FIGS. 29-30 a structure of an engine, such as a wall 2612 of a carburetor 2610, includes a first vent 2614 (e.g., conduit, passageway, flow path, channel) and a second vent 2616. According to an exemplary embodiment, the first vent 2614 connects a well of the carburetor (see, e.g., well 2512 as shown in FIG. 28) to outside air (e.g., air at atmospheric pressure, air flowing through the engine prior to passage through the constricted section of the carburetor), and the second vent 2616 connects the bowl (see, e.g., bowl 2514 as shown in FIG. 28) of the carburetor 2610 to outside air. Air from the first vent 2614 is added to fuel in the well, and the combined mixture is delivered to air passing through the carburetor 2610 by a nozzle (see, e.g., nozzle 2522 as shown in FIG. 28).

According to an exemplary embodiment, low pressure from a constricted section integrated with a main flow path (see, e.g., constricted section 2520 as shown in FIG. 28) through the carburetor 2610 provides suction to draw fuel (and air) through the nozzle. As the fuel is removed from the well via the nozzle, additional fuel is delivered to the well from the bowl and additional air is delivered to the well from the first vent 2614. The ratio of additional fuel to additional air delivered to the well is a function of the amount of resistance to flow (e.g., drag, friction, change in moment) provided between the bowl and the well, the amount of resistance through the first vent to the well, the relative viscosities of fuel and air, as well as other factors. All other things being equal, as the resistance through the first vent 614 is increased, a greater amount of fuel will be delivered from the bowl to the well in response to vacuum pressure from the nozzle, and vice versa.

According to an exemplary embodiment, the carburetor 2610 includes an adjustable surface (see, e.g., surface 2526 as shown in FIG. 28) of the constricted section. In some embodiments, the surface may be manually adjusted, such as by way of a linkage to a control lever or button. In other embodiments, the surface is automatically controlled, such as by a feedback system that is responsive to loading on the engine. In either case, adjustment of the surface changes the area of the constricted section open to air passing through the constricted section. As the constricted section is widened, the velocity of the air passing through the constricted section generally decreases and the suction acting upon the nozzle decreases.

In some embodiments, to increase the amount of fuel provided to air passing through the constricted section as the area of the constricted section widens, restriction in the first vent 2614 is increased, decreasing the amount of outside air flowing to the well while increasing the amount of fuel from the bowl flowing to the well. In other contemplated embodiments, restriction between the bowl and the well is decreased in response to an increase in the area through the constricted section. In still other contemplated embodiments, air pressure is increased in the bowl to push more fuel in the bowl into the well in response to an increase in the area through the constricted section. In other embodiments, components that control the amount of fuel injected into the air flowing through the constricted section are otherwise adjusted in response a change in area through the constricted section.

Still referring to FIGS. 29-30 a shaft (see, e.g., shaft 2524 as shown in FIG. 28) that provides a adjustable surface of the constricted section of the carburetor 2610 is also associated with the first vent 2614. In some such embodiments, a portion 2618 of the shaft includes a surface 2620 of a variable restrictor 2622 coupled to the first vent 2614. Rotation or translation of the shaft to change the area of the constricted section of the carburetor 2610 simultaneously causes the shaft to change the degree of restriction provided by the variable restrictor 2622 of the first vent 2614. In some embodiments, as the area of the constricted section increases, the amount of restriction in the first vent 2614 also increases, and vice versa. In other contemplated embodiments, a restrictor for the first vent not a portion of the shaft, but is mechanically coupled to the shaft, such as by gearing or cams.

Figure 31:
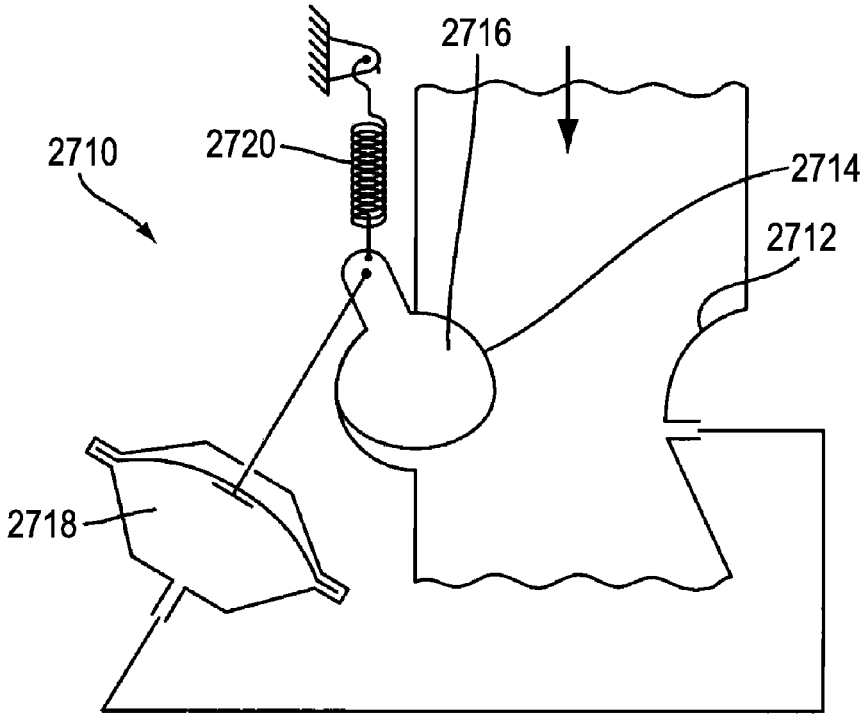
FIG. 31 is a schematic view of a control system for a carburetor in a first configuration according to an exemplary embodiment of the invention.
Figure 32:
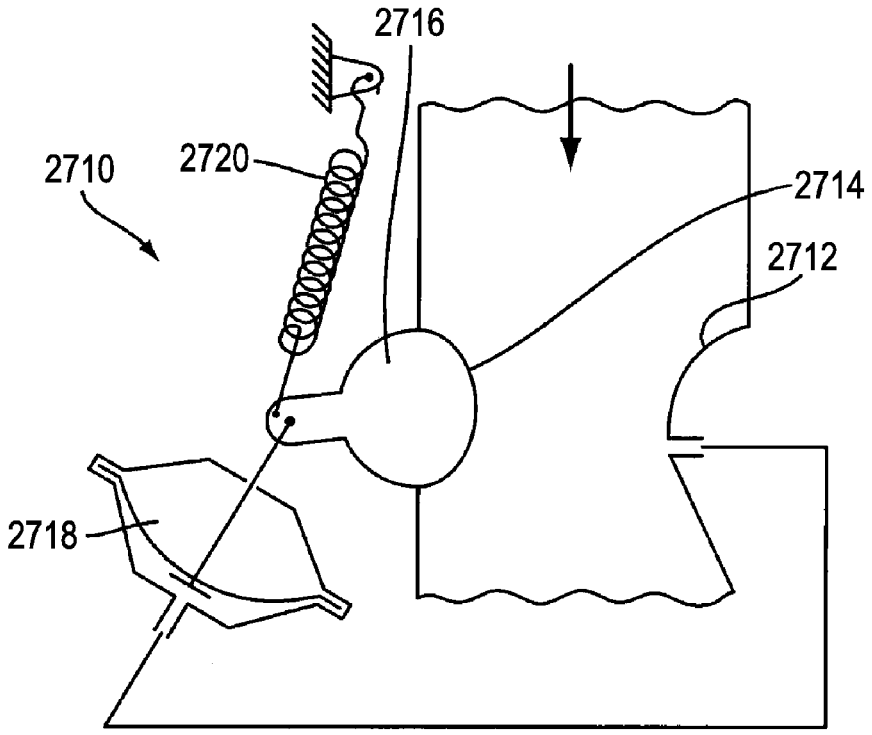
FIG. 32 is a schematic view of the control system of FIG. 10 in a second configuration.

Referring now to FIGS. 31-32, a carburetor system 2710 for an engine includes a constricted section 2712. The constricted section 2712 is at least partially formed from a surface 2714 that is adjustable. According to an exemplary embodiment, the surface 2714 is formed from a contour (e.g., non-circular portion) of a shaft 2716. As the shaft 2716 moved relative to a flow path through the constricted section 2712, the surface 2714 protrudes into the constricted section 2712 by a different amount, changing the area through the constricted section 2712.

According to an exemplary embodiment, the carburetor system 2710 further includes an actuator 2718 coupled to the shaft 2716, which is configured to move the shaft 2716 as a function of loading on the engine. In some embodiments, the actuator 2718 is pressure-sensitive (e.g., piston and rod; diaphragm) and is coupled to the engine such that the actuator 2718, which is in communication with vacuum pressure of the engine. Vacuum pressure of the engine is related to loading of the engine. In some embodiments, the actuator 2718 is coupled to the flow path through the carburetor system 2710, following the constricted section 2712. In other embodiments, the actuator 2718 is coupled to the crankcase.

During operation, a spring 2720 may bias the shaft 2716 so that the surface 2714 forming a portion of the constricted section 2712 is in a first configuration, which corresponds to a narrower opening through the constricted section 2712. If loading on the engine increases and vacuum pressure of the engine increases (i.e., venturi pressure decreases and vacuum increase), then the actuator 2718 will overcome the spring 2720, moving the shaft 2716 to a second configuration, which corresponds to a wider constricted section 2712. The wider constricted section 2712 allows for more air to flow through the carburetor system 2710 to increase the combustion processes and provide a greater output for the engine. When the loading is reduced and upon engine startup, the spring 2720 will bias the shaft 2716 into the first configuration.

In some embodiments, a locking system is used with the carburetor system 2710 to prevent the shaft 2716 from rotating when a throttle plate (see, e.g., throttle plate 2518 as shown in FIG. 28) of the carburetor system 2710 is not in a wide-open throttle configuration. In some embodiments, the carburetor system 2710 may allow for a manual override of the actuator 2718, such as by a power-boost button linked to the shaft 2716. In some embodiments, the shaft 2716 or the actuator 2718 may be coupled to a variable restrictor associated with vents to a well or bowl of the carburetor system 2710 (see, e.g., first and second vents 2614, 2616 as shown in FIGS. 29-30). In some embodiments, the surface 2714 of the shaft 2716 may be shaped as a segment of a spiral such that the area of the constricted section 2712 is continuously variable. In contemplated embodiments, a bar, plate, or other structure may include a contoured surface that translates relative to the flow path through the carburetor system 2710, to change the area of the constricted section 2712.

Figure 33:
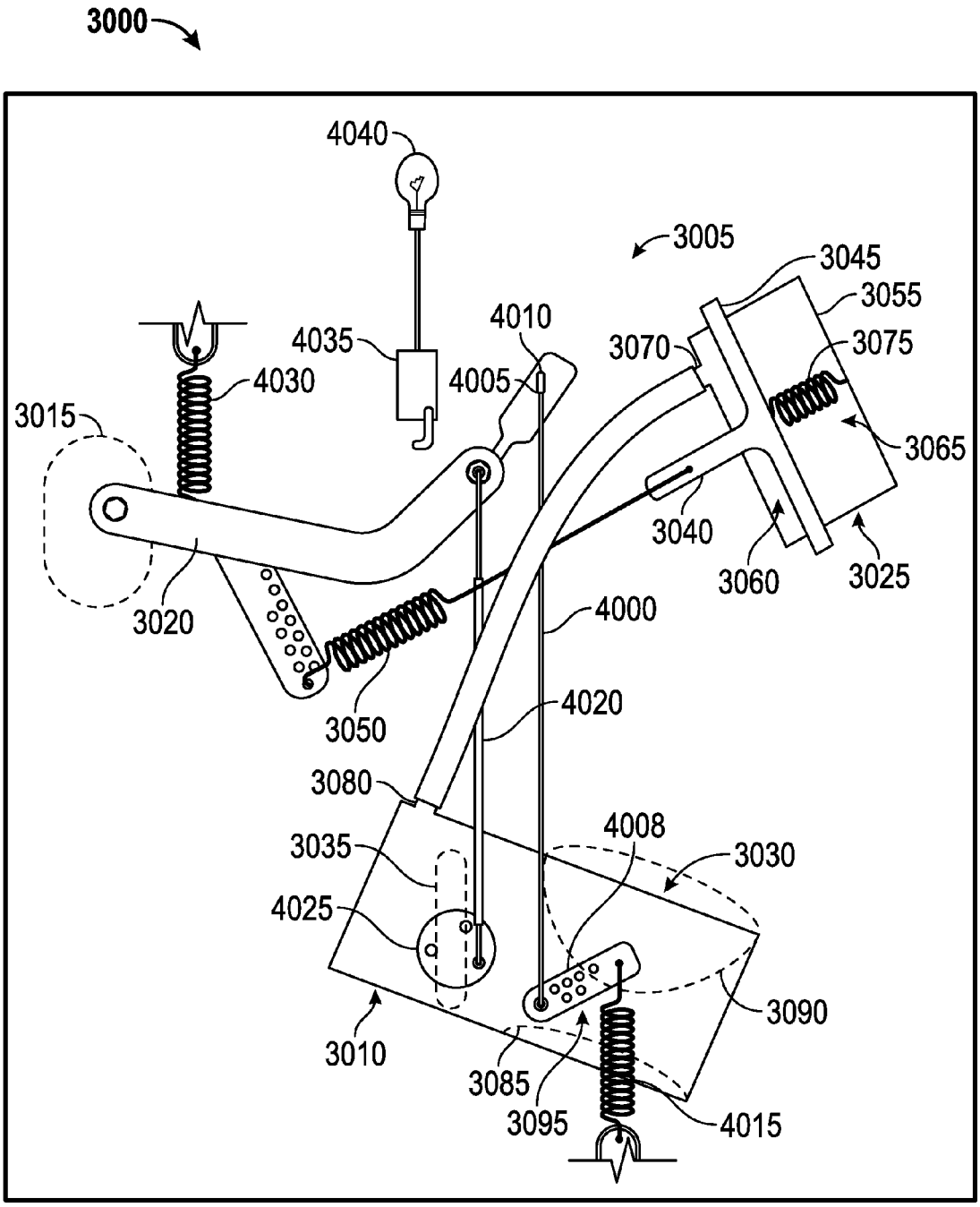
FIG. 33 is a schematic view an engine including a control system for controlling the speed of the engine and a carburetor including a variable venturi in a relatively low load condition.
Figure 34:
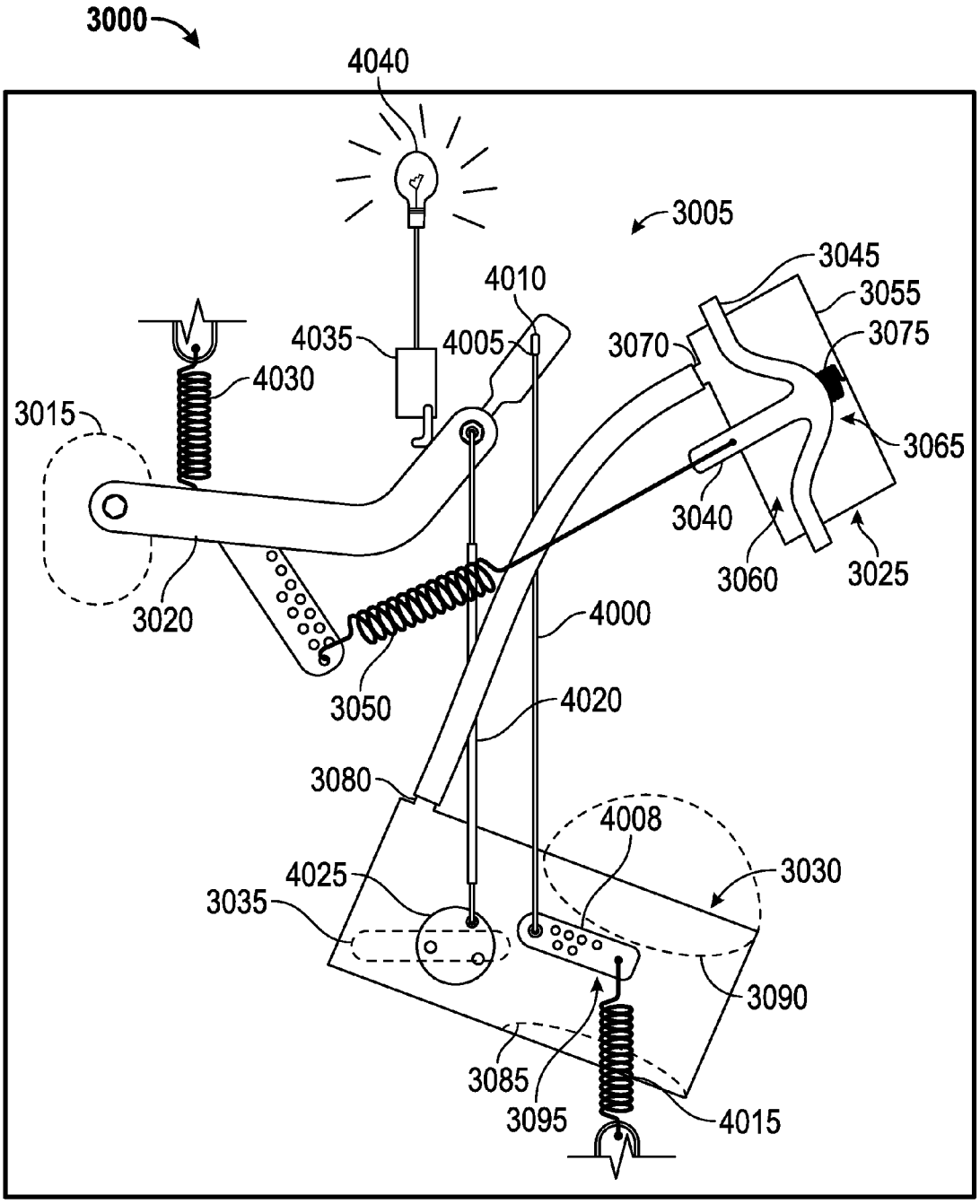
FIG. 34 is a schematic view of the engine of FIG. 33 in a relatively high load condition.

Referring to FIGS. 33-34, an engine 3000 including a control system for controlling the speed of the engine (e.g., control systems 710, 810, 910, 1310, 1410, 1510, 1560, and 1610 described above) and a carburetor including a variable venturi (e.g. carburetors, locking systems, and carburetor systems 2310, 2410, 2510, 2610, and 2710 described above) is illustrated according to an exemplary embodiment. In the illustrated embodiment, the engine 3000 includes a control system 3005 and a carburetor 3010. The control system 3005 includes a governor 3015 with a governor arm 3020 and a vacuum actuator 3025. The control system 3005 is a zero droop system configured to maintain the engine's top speed under load. This enables the engine 3000 to provide maximum power even under heavy loads. The carburetor 3010 includes a variable venturi 3030 and a throttle valve 3035. The variable venturi 3030 is configured to increase the available maximum power of the engine 3000 on an as-needed basis (e.g., under heavy loads).

The vacuum actuator 3025 includes an actuator linkage or rod 3040 that is moved by a diaphragm 3045. A governor spring 3050 couples the rod 3040 to the governor arm 3020. The governor spring 3050 biases the throttle valve 3035 to the fully open position (i.e., wide open throttle). The diaphragm 3045 divides a housing 3055 into a vacuum side 3060 and an atmosphere side 3065. An input port 3070 opens into the vacuum side 3060. The input port 3070 is in fluid communication with a source of engine vacuum (e.g., with the carburetor 3010). The diaphragm 3045 is biased towards the atmosphere side 3065 by an actuator spring 3075. Spring 3075 may be inherent in the diaphragm 3045 or a component separate from the diaphragm 3045. As the engine vacuum changes, the position of the diaphragm 3045 changes, thereby adjusting the tension on the governor spring 3050. When the engine vacuum is relatively low, tension on governor spring 3050 increases, thereby increasing the rate at which the throttle valve 3035 moves towards the fully open position when the engine is under load.

The carburetor 3010 includes an intake port 3080 downstream of the variable venturi 3030. The intake port 3080 is fluidly connected to the input port 3070 of the vacuum actuator 3025 to communicate engine vacuum to the vacuum side 3060 of the vacuum actuator 3025. The variable venturi 3030 includes a fixed surface 3085 and an adjustable surface 3090 that together form a constricted section or throat 3095. The adjustable surface 3090 is movable (e.g., rotatable, translatable, etc.) to change the size of the throat 3095. As shown in FIG. 33, with the adjustable surface 3090 in a first position (e.g., a narrow position), the throat 3095 is relatively small or narrow. As shown in FIG. 34, with the adjustable surface 3090 in a second position (e.g. a wide position), the throat 3095 is relatively large or wide, and therefore allows a greater flow of fluid through the throat 3095 than when in the narrow position. The adjustable surface 3090 is mechanically coupled to the governor arm 3020 by a link 4000 (e.g., arm, linkage, member, connector, etc.). Movement of the link 4000 causes movement to the adjustable surface 3090. Distal end 4005 of the link 4000 is received in a slot 4010 in the governor arm 3020. Movement of the governor arm 3020 that brings the distal end 4005 into contact with the end of the slot 4010 closest to the adjustable surface 3090 and then continues on past this point of contact will cause the link 4000, and therefore the adjustable surface 3090, to move. As shown in FIGS. 33-34, sufficient movement of the governor arm 3020 in a counterclockwise direction will cause movement of the adjustable surface 3090. A venturi lever 4008 mechanically couples the adjustable surface 3090 to link 4000. In some embodiments, lever 4008 is external to a carburetor housing. A spring 4015 biases the adjustable surface 3090 to the narrow position. In some embodiments, as shown in FIGS. 33 and 34, spring 4015 is coupled to lever 4008 at the end opposite link 4000.

Throttle valve 3035 is mechanically coupled to governor arm 3020 by a link 4020 so that movement of the governor arm 3020 causes movement of the throttle valve 3035. A throttle lever 4025 couples the throttle valve 3035 to the link 4020. In some embodiments, lever 4025 is external to the carburetor housing. As shown in FIGS. 33-34, counterclockwise movement of the governor arm 3020 causes the throttle valve 3035 to open. In some embodiments, an idle spring 4030 is coupled to the governor arm 3020. In other embodiments, the idle spring 4030 is omitted.

A switch 4035 is configured to be actuated by the governor arm 3020 when the governor arm 3020 is in a position that moves the adjustable surface 3090 to the wide position. The switch 4035 is coupled to an indicator 4040 (e.g., light, LED, or other appropriate indicator) that is activated (as shown in FIG. 34) to indicate to a user that the adjustable surface 3090 is in the wide position (e.g., in a "power boost" operating mode).

FIG. 33 illustrates the engine 3000 operating under a relatively light load. The throttle valve 3035 is closer to the fully closed position than the fully open position, the adjustable surface 3090 is in the narrow position, and the vacuum actuator 3025 is not providing any zero droop assist to the governor 3015 so the diaphragm 3045 is in a neutral position. The engine 3000 runs well with the adjustable surface 3090 in the narrow position and the narrow position may provide for relatively easy starting.

As the load on the engine increases, the governor 3015 detects the related change in engine speed and causes the governor arm 3020 to rotate counterclockwise, thereby opening the throttle valve 3035. As the load on the engine 3000 increases and the throttle valve 3035 opens, the engine vacuum present at intake port 3080 decreases. This drop in engine vacuum is communicated through the input port 3070 to the vacuum side 3060 of the vacuum actuator 3025. In response to the drop in engine vacuum, the diaphragm 3045 moves away from the neutral position towards the atmosphere side 3065 to a tensioning position (as shown in FIG. 34) that increases the tension on the governor spring 3050 so that the governor arm 3020 moves more quickly in the counterclockwise direction, which causes the throttle valve 3035 to open wider and faster than a system without the zero droop control provided by the vacuum actuator 3025.

As shown in FIG. 34, as the load on the engine 3000 increases to a relatively heavy load and the throttle valve 3035 is in the fully open position, the variable venturi 3030 increases the maximum power produced by the engine 3000 to accommodate these heavy loads. Under such a load, the engine speed sensed by the governor 3015 results in the governor arm 3020 moving to a position where the link 4000 moves the adjustable surface 3090 to the wide position. The distal end 4005 of the link 4000 is received in a slot 4010 in the governor arm 3020 so that transition of the adjustable surface 3090 from the narrow position to the wide position (and vice versa) happens as quickly as possible. A relatively slow transition from the narrow position to the wide position could have adverse affects on combustion due to the change in the flow rate of the fuel-air mixture through the constricted section 3095 which could result in an undesirably lean fuel-air mixture during the transition. In some embodiments, the carburetor 3010 includes a secondary fuel valve that is opened when the adjustable surface 3090 is in the wide position to make additional fuel available to be added to the increased air flow through the carburetor 3010 to provide for an appropriate fuel-air ratio for combustion when the adjustable surface 3090 is in the wide position. In some embodiments, this secondary fuel valve is triggered mechanically or in response to a threshold venturi vacuum or other vacuum. In a preferred embodiment, the variable venturi 3030 and related components (e.g., governor arm 3020, link 4000, venturi lever 4008, slot 4010, spring 4015) are configured so that the adjustable surface 3090 moves to the wide position when the engine 3000 is at 80% of maximum load.

Figure 35:
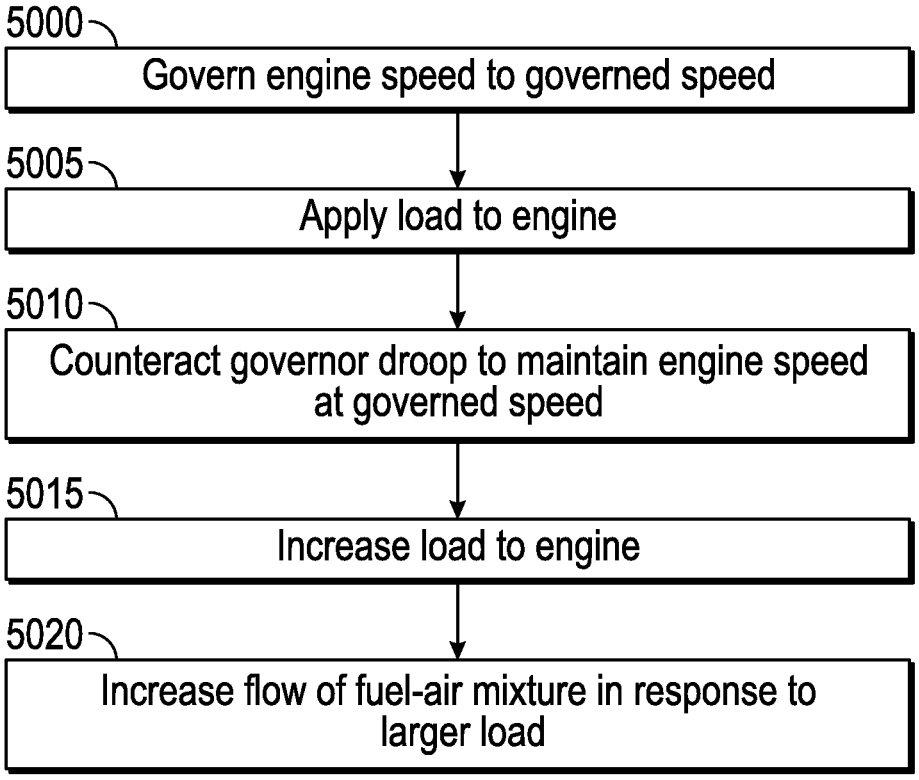
FIG. 35 is a flow chart of a method of operating an engine according to an exemplary embodiment.

Referring to FIG. 35 a method of operating an engine is illustrated according an exemplary embodiment. The engine speed is governed to a governed speed (e.g., by the governor 3015) (step 5000). A load is applied to the engine (step 5005) sufficient to cause a zero droop control system (e.g. the control system 3005) to counteract the governor droop caused by the load to maintain the engine speed at the top speed (step 5010). As the load on the engine increases (step 5015), the flow of the fuel-air mixture through a carburetor (e.g., the carburetor 3010) is increased (e.g., by the variable venturi 3030) to increase the maximum power of the engine (step 5020). It is believed that combining a zero droop control system with a variable venturi can provide greater than 20% more power than a standard engine not equipped with either one. It is believed that that the power gain provided by the combination of a zero droop control system and a variable venturi (e.g. 23%) is greater than simply adding the power gain provided by a zero droop control system on its own (e.g. 6-7%) and the power gain provided by a variable venturi on its own (e.g. 15%).

The construction and arrangements of the engines, power equipment, and components and systems thereof, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An engine, comprising:

a carburetor, comprising:

a variable venturi having a fixed surface and an adjustable surface that form a constricted section, wherein the adjustable surface is movable between a narrow position in which the constricted section has a first area and a wide position in which the constricted section has a second area larger than the first area;

a venturi lever coupled to the adjustable surface and configured to move the adjustable surface between the narrow position and the wide position;

a throttle valve downstream of the variable venturi and configured to be movable between a fully open position and a fully closed position to control a fluid flow through the carburetor;

a throttle lever coupled to the throttle valve and configured to move the throttle valve; and an intake port in fluid communication with the fluid flow;

a governor assembly including a governor configured to detect an engine speed of the engine, a governor arm coupled to the governor, the venturi lever, and the throttle lever, and a governor spring coupled to the governor arm to bias the throttle valve towards the fully open position; and a vacuum actuator including an actuator housing, a pressure-sensitive member positioned in the actuator housing and dividing the actuator housing into a vacuum side and an atmospheric side, an input port in fluid communication with the vacuum side of the actuator housing and in fluid communication with the intake port so an engine vacuum at the intake port is communicated to the vacuum side, an actuator linkage coupled to the governor spring and also coupled to the pressure-sensitive member for movement with the pressure-sensitive member in response to the engine vacuum, and an actuator spring biasing the actuator linkage to increase the tension on the governor spring.

2. The engine of claim 1, further comprising:

a venturi link coupling the venturi lever to the governor arm;

wherein the governor arm includes a slot that receives a distal end of the venturi link.

3. The engine of claim 1, wherein the intake port is downstream of the variable venturi.

4. The engine of claim 1, further comprising:

a switch configured to be actuated when the governor arm is a position that moves the adjustable surface to the wide position; and an indicator electrically coupled to the switch to indicate when the adjustable surface is in the wide position.

5. The engine of claim 1, wherein at a first load on the engine, the governor arm is in a first position where the adjustable surface is in the narrow position, the throttle valve is not in the fully open position, and a first engine vacuum is communicated to the vacuum side of the vacuum actuator; and wherein at a second load on the engine, greater than the first load on the engine, the governor arm is in a second position where the adjustable surface is in the wide position, the throttle valve is in the fully open position and a second engine vacuum, less than the first engine vacuum is communicated to the vacuum side of the vacuum actuator.

6. The engine of claim 5, further comprising:

a venturi link coupling the venturi lever to the governor arm;

wherein the governor arm includes a slot that receives a distal end of the venturi link.

7. The engine of claim 5, wherein the intake port is downstream of the variable venturi.

8. The engine of claim 5, further comprising:

a switch configured to be actuated when the governor arm is a position that moves the adjustable surface to the wide position; and an indicator electrically coupled to the switch to indicate when the adjustable surface is in the wide position.

9. The engine of claim 8, further comprising:

a venturi link coupling the venturi lever to the governor arm;

wherein the governor arm includes a slot that receives a distal end of the venturi link.

10. The engine of claim 9, wherein the intake port is downstream of the variable venturi.

11. Outdoor power equipment, comprising:

a frame;

wheels coupled to the frame;

a fuel tank;

an engine mounted to the frame, comprising:

a carburetor, comprising:

a variable venturi having a fixed surface and an adjustable surface that form a constricted section, wherein the adjustable surface is movable between a narrow position in which the constricted section has a first area and a wide position in which the constricted section has a second area larger than the first area;

a venturi lever coupled to the adjustable surface and configured to move the adjustable surface between the narrow position and the wide position;

a throttle valve downstream of the variable venturi and configured to be movable between a fully open position and a fully closed position to control a fluid flow through the carburetor;

a throttle lever coupled to the throttle valve and configured to move the throttle valve; and an intake port in fluid communication with the fluid flow;

a governor assembly including a governor configured to detect an engine speed of the engine, a governor arm coupled to the governor, the venturi lever, and the throttle lever, and a governor spring coupled to the governor arm to bias the throttle valve towards the fully open position; and a vacuum actuator including an actuator housing, a pressure-sensitive member positioned in the actuator housing and dividing the actuator housing into a vacuum side and an atmospheric side, an input port in fluid communication with the vacuum side of the actuator housing and in fluid communication with the intake port so an engine vacuum at the intake port is communicated to the vacuum side, an actuator linkage coupled to the governor spring and also coupled to the pressure-sensitive member for movement with the pressure-sensitive member in response to the engine vacuum, and an actuator spring biasing the actuator linkage to increase the tension on the governor spring; and a rotating tool driven by the engine.

12. The outdoor power equipment of claim 11, further comprising:

a venturi link coupling the venturi lever to the governor arm;

wherein the governor arm includes a slot that receives a distal end of the venturi link.

13. The outdoor power equipment of claim 11, wherein the intake port is downstream of the variable venturi.

14. The outdoor power equipment of claim 11, further comprising:

a switch configured to be actuated when the governor arm is a position that moves the adjustable surface to the wide position; and an indicator electrically coupled to the switch to indicate when the adjustable surface is in the wide position.

15. The outdoor power equipment of claim 11, wherein at a first load on the engine, the governor arm is in a first position where the adjustable surface is in the narrow position, the throttle valve is not in the fully open position, and a first engine vacuum is communicated to the vacuum side of the vacuum actuator; and wherein at a second load on the engine, greater than the first load on the engine, the governor arm is in a second position where the adjustable surface is in the wide position, the throttle valve is in the fully open position and a second engine vacuum, less than the first engine vacuum is communicated to the vacuum side of the vacuum actuator.

16. A method of operating an engine, comprising:

governing an engine speed to a governed speed;

applying a load to the engine;

counteracting governor droop to maintain the engine speed at the governed speed;

increasing the load on the engine;

increasing a flow of fuel-air mixture through a carburetor in response to the increased load, wherein increasing the flow of fuel-air mixture is achieved by increasing the size of a restricted section of a venturi of the carburetor in response to an engine speed sensed by the governor; and indicating to a user with an indicator the increased flow of fuel-air mixture.

17. The method of claim 16, wherein counteracting governor droop occurs in response to a change in an engine vacuum.

18. The method of claim 16, wherein increasing the size of a restricted section of a venturi of the carburetor is achieved by moving an adjustable surface of the venturi relative to a fixed surface of the venturi.

* * * * *